US007900597B2

(12) United States Patent
Meneely et al.

(10) Patent No.: US 7,900,597 B2
(45) Date of Patent: Mar. 8, 2011

(54) SELF-CONTAINED COMPRESSION BRAKECONTROL MODULE FOR COMPRESSION-RELEASE BRAKESYSTEM OF INTERNAL COMBUSTION ENGINE

(75) Inventors: Vincent Meneely, Fort Langley (CA); Robert Price, Manchester, CT (US)

(73) Assignee: Pacbrake Company, Seattle, WA (US)

( * ) Notice: Subject to any disclaimer, the term of this patent is extended or adjusted under 35 U.S.C. 154(b) by 0 days.

(21) Appl. No.: 12/533,628

(22) Filed: Jul. 31, 2009

(65) Prior Publication Data

US 2010/0024767 A1 Feb. 4, 2010

Related U.S. Application Data

(60) Provisional application No. 61/085,110, filed on Jul. 31, 2008.

(51) Int. Cl.
*F02D 9/06* (2006.01)

(52) U.S. Cl. ..... 123/323; 123/90.12; 123/568.14

(58) Field of Classification Search ..... 123/90.12, 123/90.15, 90.16, 321–323, 568.14; 60/602
See application file for complete search history.

(56) References Cited

U.S. PATENT DOCUMENTS

| | | | | |
|---|---|---|---|---|
| 3,786,792 | A | | 1/1974 | Pelizzoni et al. |
| 4,158,348 | A | | 6/1979 | Mason et al. |
| 4,706,625 | A | | 11/1987 | Meistrick et al. |
| 4,996,957 | A | | 3/1991 | Meistrick |
| 5,088,460 | A | | 2/1992 | Echeverria |
| 5,255,650 | A | | 10/1993 | Faletti et al. |
| 5,379,737 | A | | 1/1995 | Hu |
| 5,460,131 | A | | 10/1995 | Usko |
| 5,462,025 | A | | 10/1995 | Israel et al. |
| 5,495,838 | A | | 3/1996 | Johnson, Jr. |
| 5,564,386 | A | | 10/1996 | Korte et al. |
| 5,619,964 | A | | 4/1997 | Feucht |
| 5,787,858 | A | * | 8/1998 | Meneely ..... 123/321 |
| 6,085,526 | A | * | 7/2000 | Bischoff ..... 60/602 |
| 6,085,721 | A | * | 7/2000 | Dodi et al. ..... 123/321 |
| 6,170,474 | B1 | * | 1/2001 | Israel ..... 123/568.14 |
| 6,334,429 | B1 | | 1/2002 | Little, Jr. |
| 6,705,282 | B2 | | 3/2004 | Hlavac |
| 6,715,466 | B2 | | 4/2004 | Cotton, III et al. |
| 2002/0174654 | A1 | * | 11/2002 | Yang ..... 60/602 |
| 2004/0231639 | A1 | * | 11/2004 | Israel et al. ..... 123/321 |
| 2005/0224046 | A1 | * | 10/2005 | Israel et al. ..... 123/321 |
| 2008/0006231 | A1 | * | 1/2008 | Noss et al. ..... 123/90.12 |

FOREIGN PATENT DOCUMENTS

EP 1 156 193 11/2001

* cited by examiner

*Primary Examiner* — Stephen K Cronin
*Assistant Examiner* — Johnny H Hoang
(74) *Attorney, Agent, or Firm* — Berenato & White, LLC

(57) ABSTRACT

A compression-release brake system for operating an exhaust valve of an engine during an engine braking operation. The compression-release brake system comprises a self-contained compression brake control module (CBCM) operatively coupled to the exhaust valve for controlling a lift and a phase angle thereof and a source of a pressurized hydraulic fluid. The CBCM includes a casing defining piston and actuator cavities, a slave piston mounted within the piston cavity, a check valve provided between a supply conduit and a slave piston chamber and a compression brake actuator disposed in the actuator cavity. The compression brake actuator includes an actuator element and a biasing spring. The actuator element selectively engages the check valve when deactivated so as to unlock the slave piston chamber, and disengages from the check valve when activated so as to lock the slave piston chamber. The actuator element is exposed to atmospheric pressure.

36 Claims, 16 Drawing Sheets

SELF-CONTAINED COMPRESSION BRAKECONTROL MODULE FOR COMPRESSION-RELEASE BRAKESYSTEM OF INTERNAL COMBUSTION ENGINE

CROSS-REFERENCE TO RELATED APPLICATION

This Application claims the benefit under 35 U.S.C. 119(e) of U.S. Provisional Application No. 61/085,110 filed Jul. 31, 2008 by Meneely, V. et al.

BACKGROUND OF THE INVENTION

1. Field of the Invention

The present invention relates to compression-release brake systems for internal combustion engines in general, and, more particularly, to a self-contained compression-release brake control module for a compression-release engine brake system of an internal combustion engine.

2. Description of the Prior Art

For internal combustion engines (IC engine), especially diesel engines of large trucks, engine braking is an important feature for enhanced vehicle safety. Consequently, the diesel engines in vehicles, particularly large trucks, are commonly equipped with compression-release engine brake systems (or compression-release retarders) for retarding the engine (thus, vehicle). The compression release engine braking provides significant braking power in a braking mode of operation. For this reason, the compression-release engine brake systems have been in North America since the 1960's.

The typical compression-release engine brake systems open exhaust valve(s) just prior to Top Dead Center (TDC) at the end of a compression stroke, which is a standard technology for a compression-release engine braking. This creates a blow-down of the compressed cylinder gas and the energy used for compression is not reclaimed. The result is engine braking, or retarding, power. A conventional compression-release engine brake system has substantial cost associated with the hardware required to open the exhaust valve(s) against the extremely high load of a compressed cylinder charge. Valve train components must be designed and manufactured to operate reliably at high mechanical loading. Also, the sudden release of the highly compressed gas comes with a high level of noise. In some areas, engine brake use is not permitted because the existing compression-release engine brake systems open the valves quickly at high compression pressure near the TDC compression that produces high engine valve train loads and a loud sound, which has resulted in prohibition of engine compression release brake usage in certain urban areas.

Typically, the compression-release engine brake systems up to this time are unique and custom designed and engineered to a particular engine make. The design, prototype fabrication, bench testing, engine testing and field testing typically require twenty four (24) months to complete prior to sales release. Accordingly, both the development time and cost have been an area of concern.

Exhaust brake systems can be used on engines where compression release loading is too great for the valve train. The exhaust brake mechanism consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

While known compression-release engine brake systems have proven to be acceptable for various vehicular driveline applications, such devices are nevertheless susceptible to improvements that may enhance their performance and cost. With this in mind, a need exists to develop improved compression-release engine brake systems that advance the art, such as a self-contained compression brake control module for a compression-release brake system of an internal combustion engine that significantly reduces the development time and cost of the compression-release engine brake system and enhances performance thereof.

SUMMARY OF THE INVENTION

The present invention provides a novel compression-release brake system for operating at least one exhaust valve of an internal combustion engine during a compression-release engine braking operation. The compression-release brake system of the present invention comprises an exhaust rocker assembly for operating the exhaust valve, a self-contained compression brake control module (CBCM) operatively coupled to the exhaust valve for controlling a lift and a phase angle thereof, and a source of a pressurized hydraulic fluid in fluid communication with the CBCM. The CBCM is provided to maintain the exhaust valve open during a compression stroke of the engine when the engine performs the compression-release engine braking operation.

The CBCM of the present invention comprises a casing including a single-piece body defining a piston cavity and an actuator cavity separated by a separation wall and being in fluid communication with each other through a connecting passage in the separation wall, and a slave piston slidingly mounted within the piston cavity for reciprocating within the piston cavity between an extended position and a collapsed position so as to engage the exhaust valve in the extended position thereof. The casing and the slave piston define a variable volume hydraulic slave piston chamber within the piston cavity between the separation wall and the slave piston. The CBCM further comprises a supply conduit formed within the casing so as to provide the pressurized hydraulic fluid from the source of pressurized hydraulic fluid to the hydraulic slave piston chamber to extend the slave piston to the extended position thereof when there is a gap between the slave piston and the exhaust valve, a check valve provided between the supply conduit and the hydraulic slave piston chamber to hydraulically lock the hydraulic slave piston chamber by closing the connecting passage in the separation wall when a pressure of the hydraulic fluid within the hydraulic slave piston chamber exceeds the pressure of the hydraulic fluid from the source, and a compression brake actuator disposed in the actuator cavity.

The compression brake actuator includes an actuator element slidingly mounted within the actuator cavity for reciprocating between an extended position when deactivated and a retracted position when activated, and a compression spring biasing the actuator element toward the extended position. The actuator element selectively engages and opening said check valve when deactivated solely by the biasing force of the compression spring so as to unlock the hydraulic slave piston chamber and fluidly connect the hydraulic slave piston chamber to the source of pressurized hydraulic fluid, and disengage from the check valve when activated so as to lock the hydraulic slave piston chamber and fluidly disconnect the hydraulic slave piston chamber from the source of pressurized hydraulic fluid. Moreover, the actuator element is exposed to atmospheric pressure.

According to a first exemplary embodiment of the present invention, the CBCM is hydraulically actuated and the compression-release brake system further comprises an external control valve to supply the pressurized hydraulic fluid to the CBCM during the compression-release engine braking operation. To deactivate the compression-release brake system, the external control valve dumps the pressurized hydraulic fluid to a hydraulic fluid sump. With the hydraulic controlled CBCM, the slave piston chamber is completely filled with the hydraulic fluid during the normal exhaust stroke when the exhaust valve is lifted off its valve seat by the normal exhaust cam profile. The hydraulic fluid in the slave piston chamber is hydraulically locked by the check valve located above the slave piston to hold the slave piston in the extended position. At the completion of the normal exhaust valve motion, the extended slave piston stops the exhaust valve from returning to the valve seat and thereby holds the exhaust valve open.

According to a second exemplary embodiment of the present invention, the CBCM is electrically actuated and the compression-release brake system does not require an additional external control valve to supply and turn on and off the supply of the pressurized hydraulic fluid. The compression brake actuator of the electrically actuated CBCM comprises a solenoid including a solenoid coil and the actuator element in the form of an armature slidingly mounted within the solenoid coil for reciprocating therewithin.

According to a third exemplary embodiment of the present invention, the CBCM is electrically actuated and the compression-release brake system further comprises an external control valve to supply the pressurized hydraulic fluid to the CBCM during the compression-release engine braking operation so as to define a timed electronically controlled compression-release brake system. The solenoid of the compression brake actuator of the electrically actuated CBCM is energized and de-energized during each engine cycle to control the engine brake exhaust valve opening and closing events. The external control valve supplies the CBCM with low pressure hydraulic fluid and the CBCM integrated solenoid allows opening and closing of the check valve to control the timed compression-release engine braking operation.

According to a fourth exemplary embodiment of the present invention, the CBCM is pneumatically actuated and the compression-release brake system further comprises a source of a compressed air so as to provide the compressed air from the source to the CBCM and an external compression brake control valve provided to selectively fluidly connect the source of the compressed air to the pneumatically actuated CBCM, but does not require an additional external control valve to supply the pressurized hydraulic fluid to the CBCM during the compression-release engine braking operation.

Moreover, according to the second to fourth exemplary embodiments of the present invention, the CBCM is spaced from the exhaust rocker assembly so that the exhaust rocker assembly is movable relative to the CBCM so that the single-piece body of the CBCM is non-movably fixed to a cylinder head or a cylinder block of the engine.

According to a fifth exemplary embodiment of the present invention, the compression-release brake system includes a dedicated brake rocker assembly added in addition to conventional intake and exhaust rocker assemblies. The dedicated brake rocker assembly comprises a dedicated compression-release cam member and a dedicated brake rocker arm. The CBCM is mounted to one end of the brake rocker arm so that the CBCM is disposed adjacent to the exhaust valve for operatively coupling the dedicated brake rocker assembly with the exhaust valve.

Therefore, a compression-release brake system in accordance with the present invention with a self-contained compression brake control module improves and optimizes operational characteristics of the internal combustion engine and provides small compact and universal design, allows for individual cylinder application and component flexibility, requires minimum fluid compliance, lowers engineering and component cost, and reduces development time.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 1A:
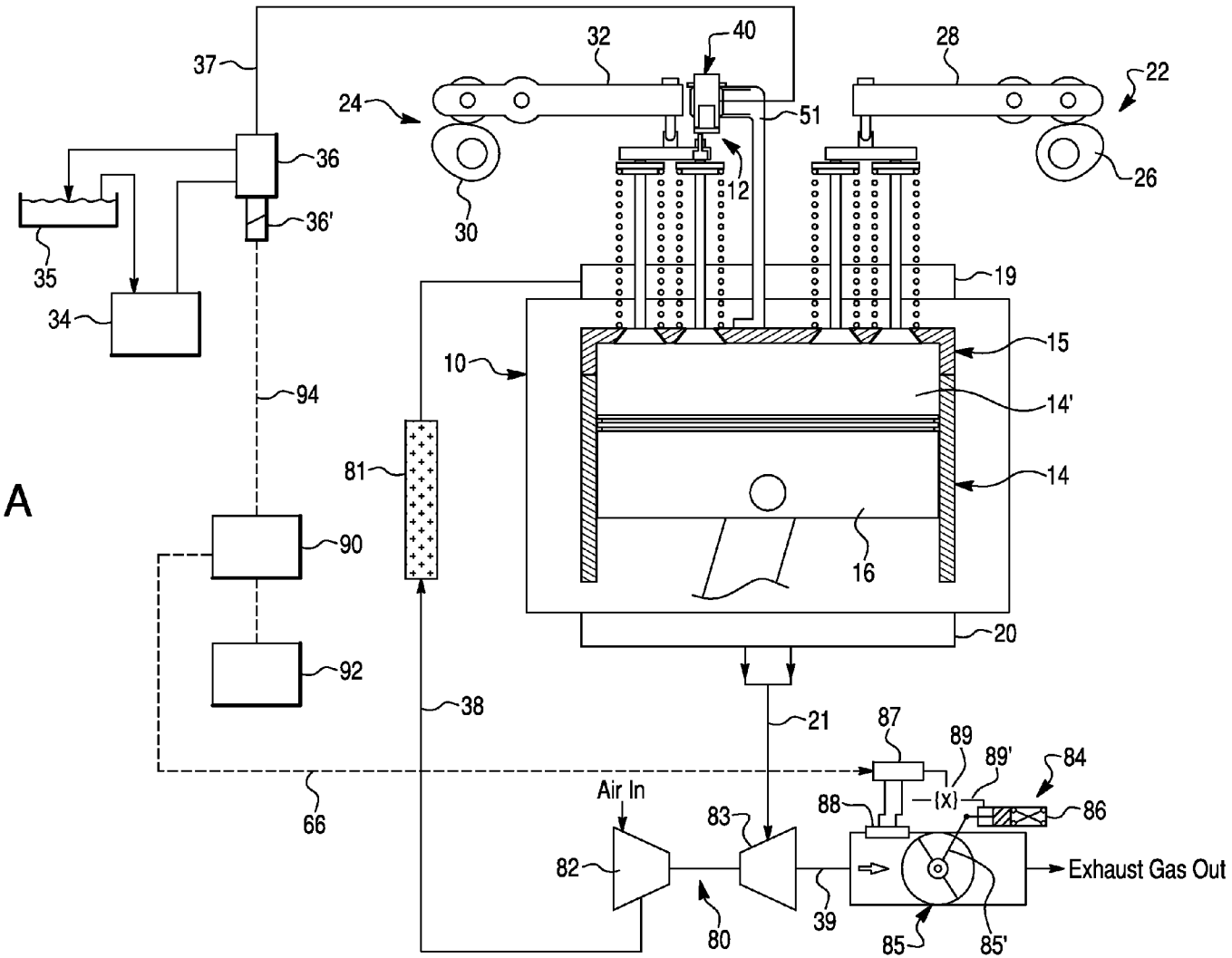
FIG. 1 is a schematic view of an internal combustion engine including a compression-release brake system according to a first exemplary embodiment of the present invention.

The preferred embodiments of the present invention will now be described with the reference to accompanying drawings.

For purposes of the following description, certain terminology is used in the following description for convenience only and is not limiting. The words such as "front" and "rear", "left" and "right", "inwardly" and "outwardly" designate directions in the drawings to which reference is made. The words "smaller" and "larger" refer to relative size of elements of the apparatus of the present invention and designated portions thereof. The terminology includes the words specifically mentioned above, derivatives thereof and words of similar import.

Figure 1B:
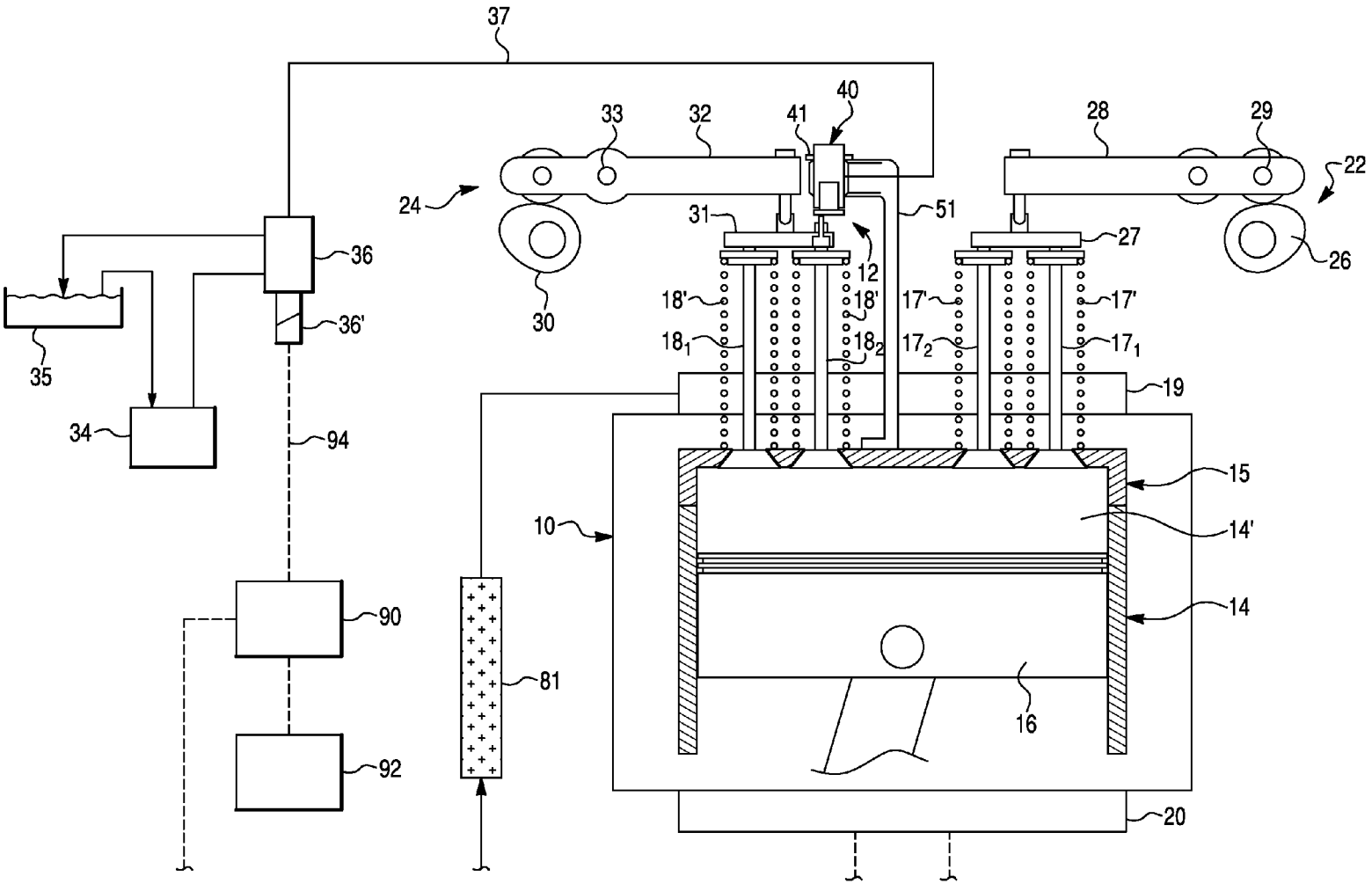

FIG. 1 schematically depicts a compression-release (or weeper) brake system 12 according to a first exemplary embodiment of the present invention, provided for an internal combustion (IC) engine 10. Preferably, the IC engine 10 is a four-stroke diesel engine, comprising a cylinder block 14 including a plurality of cylinders 14'. However, for the sake of simplicity, only one cylinder 14' is shown in FIG. 1. Each cylinder 14' is provided with a piston 16 that reciprocates therein. Each cylinder 14' is further provided with two intake valves $\mathbf{17}_1$ and $\mathbf{17}_2$, and two exhaust valves $\mathbf{18}_1$ and $\mathbf{18}_2$, each provided with a return spring 17' or 18', respectively, and a valve train provided for lifting and closing of the intake and exhaust valves 17 and 18. The intake valves $\mathbf{17}_1$ and $\mathbf{17}_2$ as well as exhaust valves $\mathbf{18}_1$ and $\mathbf{18}_2$ are substantially structurally identical in this embodiment. In view of these similarities, and in the interest of simplicity, the following discussion will sometimes use a reference numeral without a letter to designate both substantially identical valves. For example, the reference numeral 17 will be sometimes used when generically referring to each of the intake valves $\mathbf{17}_1$ and $\mathbf{17}_2$, while the reference numeral 18 will be sometimes used when generically referring to each of the exhaust valves $\mathbf{18}_1$ and $\mathbf{18}_2$ rather than reciting all two reference numerals. It will be appreciated that each cylinder 14' may be provided with one or more intake valve(s) and/or exhaust valve(s), although two of each is shown in FIG. 1. The engine 10 also includes an intake manifold 19 and an exhaust manifold 20 both in fluid communication with the cylinder 14'. The IC engine 10 is capable of performing a positive power operation (normal engine cycle) and an engine brake operation (engine brake cycle). The compression-release brake system 12 operates in a compression brake mode (during the engine brake operation) and a compression brake deactivation mode (during the positive power operation).

The valve train of the present invention includes an intake rocker assembly 22 for operating the intake valves 17, and an exhaust rocker assembly 24 for operating the exhaust valves 18. The intake rocker assembly 22 includes an intake cam member 26, an intake rocker arm 28 mounted about an intake rocker shaft 29 and provided to open the intake valves 17 through an intake valve bridge 27. Similarly, the exhaust rocker assembly 24 includes an exhaust cam member 30, an exhaust rocker arm 32 mounted about an exhaust rocker shaft 33 and provided to open the exhaust valves 18 (i.e., the exhaust valves $\mathbf{18}_1$ and $\mathbf{18}_2$) through an exhaust valve bridge 31.

As further illustrated in FIG. 1, the compression-release brake system 12 according to the first exemplary embodiment of the present invention comprises a self-contained compression brake control module (or CBCM) 40 for selectively controlling a lift and a phase angle of at least one of the exhaust valves 18. In the preferred embodiment of the present invention, the CBCM 40 is provided for selectively controlling a lift and a phase angle of at least one of the exhaust valve $\mathbf{18}_2$ which is capable to function as a brake exhaust valve. In other words, the CBCM 40 is provided for selectively controlling a valve lash of the brake exhaust valve $\mathbf{18}_2$. In fact, the compression brake control module 40 is a hydraulically expandable linkage that is integrated into the valve train of the I.C. engine 10. The compression brake control module 40 is an essential part of the compression-release brake system 12 that holds the brake exhaust valve $\mathbf{18}_2$ off the valve seat a preset amount for either the full engine cycle or a partial engine cycle. The compression-release brake system 12 can be combined with an exhaust brake to provide two-cycle braking. The compression brake control module 40 according to the first exemplary embodiment of the present invention, is a universal compact mechanism that can be applied to different engine configurations with only slight modifications to mount the compression brake control module 40 to different engine valve train overheads.

In the first exemplary embodiment, illustrated in FIG. 1, the compression brake control module 40 is fixed (i.e., non-movably, attached to a stationary part of the engine) so as to be operatively disconnected from and spaced from the exhaust rocker assembly 24. Specifically, the compression brake control module 40 is disposed adjacent to the exhaust valves 18 and spaced from the exhaust rocker arm 32. More specifically, as illustrated in details in FIGS. 3 and 4, the compression brake control module 40 comprises a hollow casing in the form of a cylindrical single-piece body 42 defining a cylindrical piston cavity 44 and a cylindrical actuator cavity 45 separated by a inner (or separation) wall 46 and being in fluid communication with each other through a connecting passage 47 in the inner wall 46. As further illustrated in FIGS. 3 and 4, a cylindrical outer peripheral surface 43 of the casing 42 is at least partially threaded so as to be threadedly received in an internally threaded bore of a support member 51 fixed to a cylinder head 15 (or the cylinder block 14) of the I.C. engine 10 (as shown in FIGS. 1 and 2A-2C). A lock nut 41 is provided to adjustably fasten and retain the casing 42 of the CBCM 40 to the support member 51. Thus, the casing 42 of the CBCM 40 is non-movably mounted to the I.C. engine 10. The CBCM 40 further comprises a slave piston 48 slidingly mounted within the casing 42 for reciprocating within the piston cavity 44 between an extended position (shown in FIG. 3) and a collapsed position (shown in FIG. 4) so that the casing 42 and the slave piston 48 define a variable volume hydraulic slave piston chamber 50 within an innermost portion of the cylindrical piston cavity 44 between an inner end face 49*a* of the piston 48 and the inner wall 46 of the casing 42. The slave piston 48 has an annular elastomeric seal 52 which eliminates piston to bore leakage in the extended (or on) position when the compression brake control module 40 is activated (or on) and holds the slave piston 48 in the collapsed (or off) position when the compression brake control module 40 is deactivated (or off). The elastomeric seal 52 functions as a return spring (or replaces a return spring) biasing the slave piston 48 to the collapsed (or innermost) position thereof. Specifically, the annular elastomeric seal 52 has enough friction so the slave piston 48 stays put in the bore and does not allow the slave piston 48 to drop down in its bore, therefore no return spring is required. In other words, the annular elastomeric seal 52 takes the place of a light force spring to keep the slave piston 48 from dropping down and causing the slave piston 48 and exhaust valve bridge 31 collision. An outer end face 49*b* of the slave piston 48 is provided to engage the brake exhaust valve $\mathbf{18}_2$ in the extended position thereof through an exhaust valve pin 25 reciprocatingly mounted to the exhaust valve bridge 31. In other words, the exhaust valve pin 25 is reciprocatingly movable relative to the exhaust valve bridge 31 so as to make the brake exhaust valve $\mathbf{18}_2$ movable relative to the exhaust valve $\mathbf{18}_1$ and the exhaust valve bridge 31.

Figure 3:
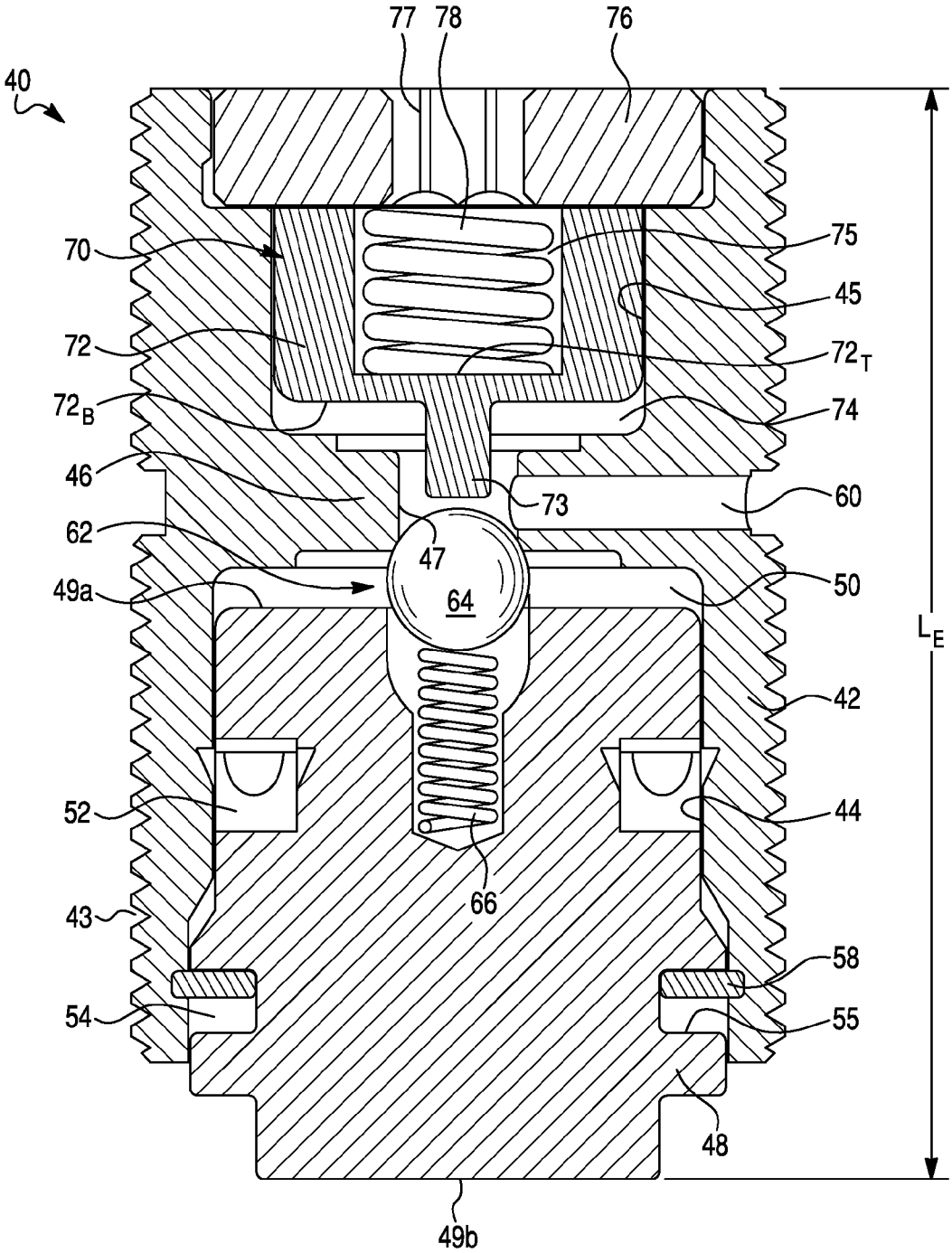
FIG. 3 is a sectional view of a hydraulically actuated compression brake control module of the compression-release brake system according to the first exemplary embodiment of the present invention in a depressurized condition.
Figure 4:
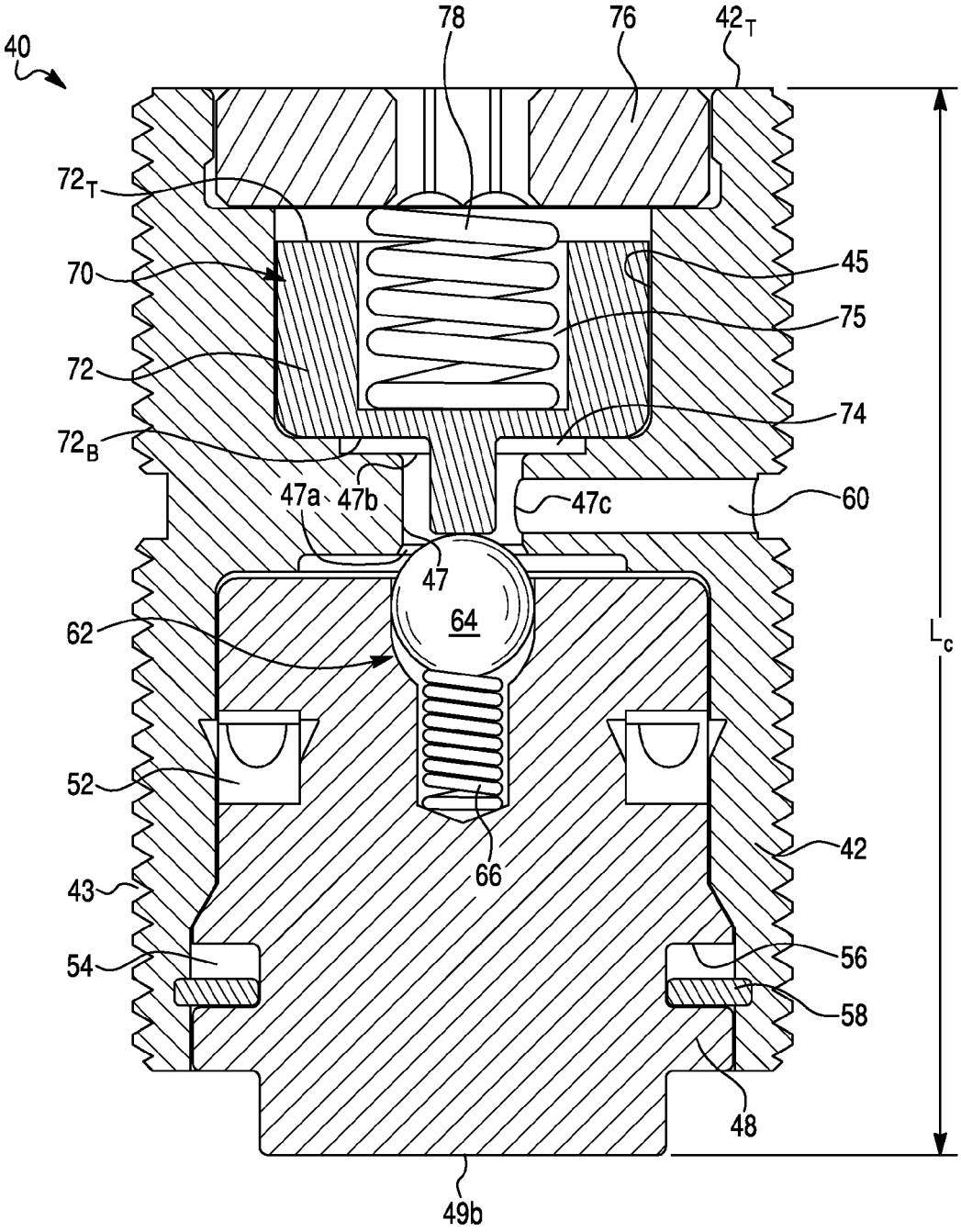
FIG. 4 is a sectional view of the hydraulically actuated compression brake control module of the compression-release brake system according to the first exemplary embodiment of the present invention in a pressurized condition.

The slave piston 48 can reciprocate within the piston cavity 44 between two mechanical slave piston stops defining the extended position (shown in FIG. 3) and the collapsed position (shown in FIG. 4). Preferably, the slave piston 48 is formed with an annular piston groove 54 having annular flat, axially opposite outer and inner stop surfaces 55 and 56, respectively, while the casing 42 is provided with a slave piston stop member in the form of a snap ring 58, which is seated in a complementary groove formed in a lower interior portion of the casing 42 so as to extend into the piston groove 54 between the outer and inner stop surfaces 55 and 56 thereof and to mechanically limit of inward and outward movements of the slave piston 48. As illustrated in FIGS. 3 and 4, the width of the piston groove 54 is substantially larger than the width of the snap ring 58 so as to allow the slave piston 48 to reciprocate within the piston cavity 44 between the outer and inner stop surfaces 55 and 56 of the piston groove 54. In other words, the slave piston 48 can extend outwardly from the piston cavity 44 until the inner stop surface 56 of the piston groove 54 contacts the stop member 58, as illustrated in FIG. 3, which is defined as the extended position. Similarly, the slave piston 48 can retract inwardly into the piston cavity 44 until the outer stop surface 55 of the piston groove 54 contacts the stop member 58, as illustrated in FIG. 4, which is defined as the collapsed position. Thus, the piston groove 54 functions as a stroke limiting slot. A length of the CBCM 40 in the extended position (illustrated in FIG. 3) is $L_E$, while the length of the CBCM 40 in the collapsed position (illustrated in FIG. 4) is $L_C$ which is smaller than the length $L_E$. The annular elastomeric seal 52 of the hydraulically activated compression brake control module 40, according to the first exemplary embodiment of the present invention, eliminates oil leakage from the high pressure hydraulic slave piston chamber 50 and holds the slave piston 48 in the collapsed position without an additional return spring.

Figure 2A:
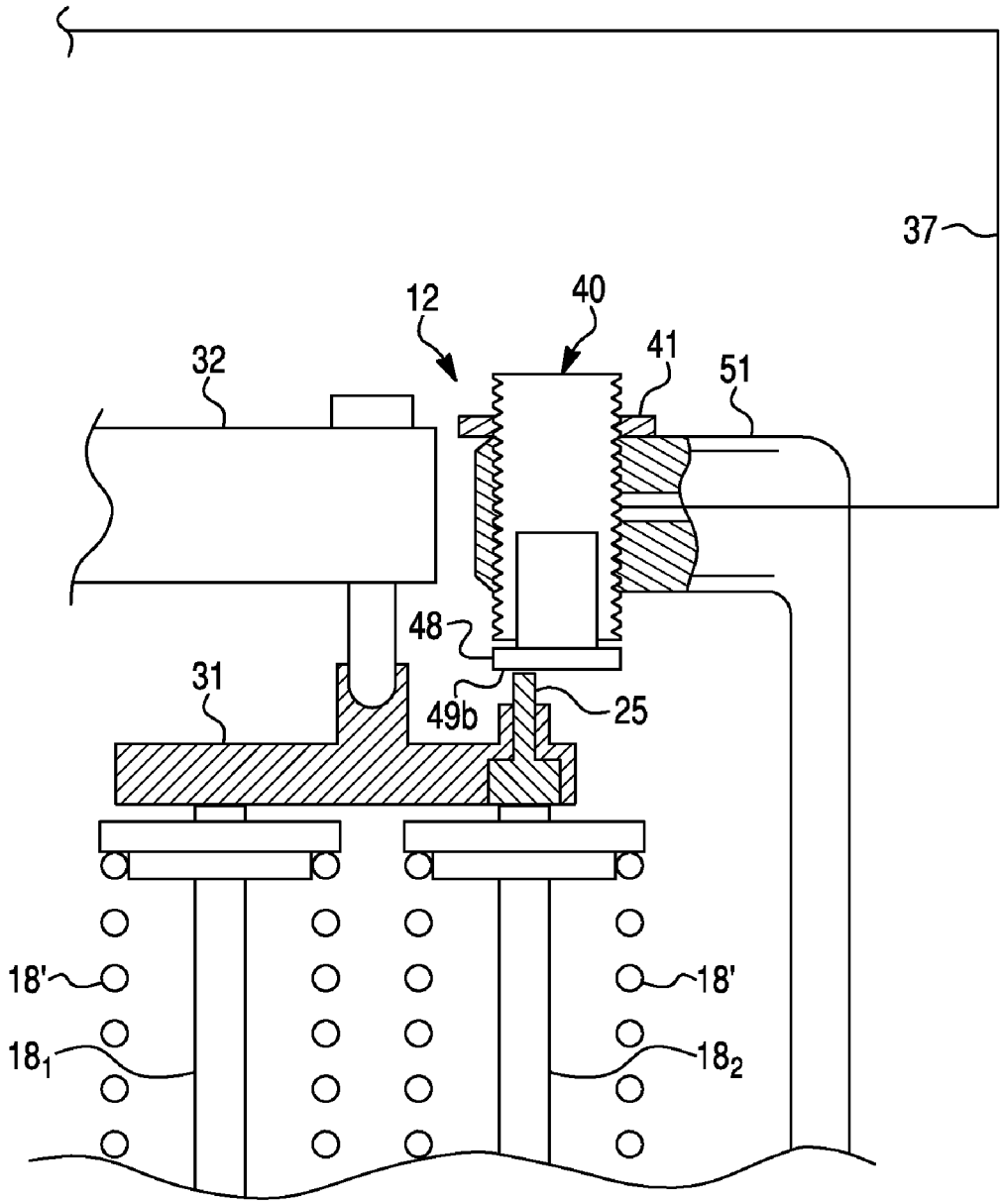
FIG. 2A is an enlarged schematic view of the portion of the compression-release brake system according to the first exemplary embodiment of the present invention with exhaust valves closed.
Figure 2B:
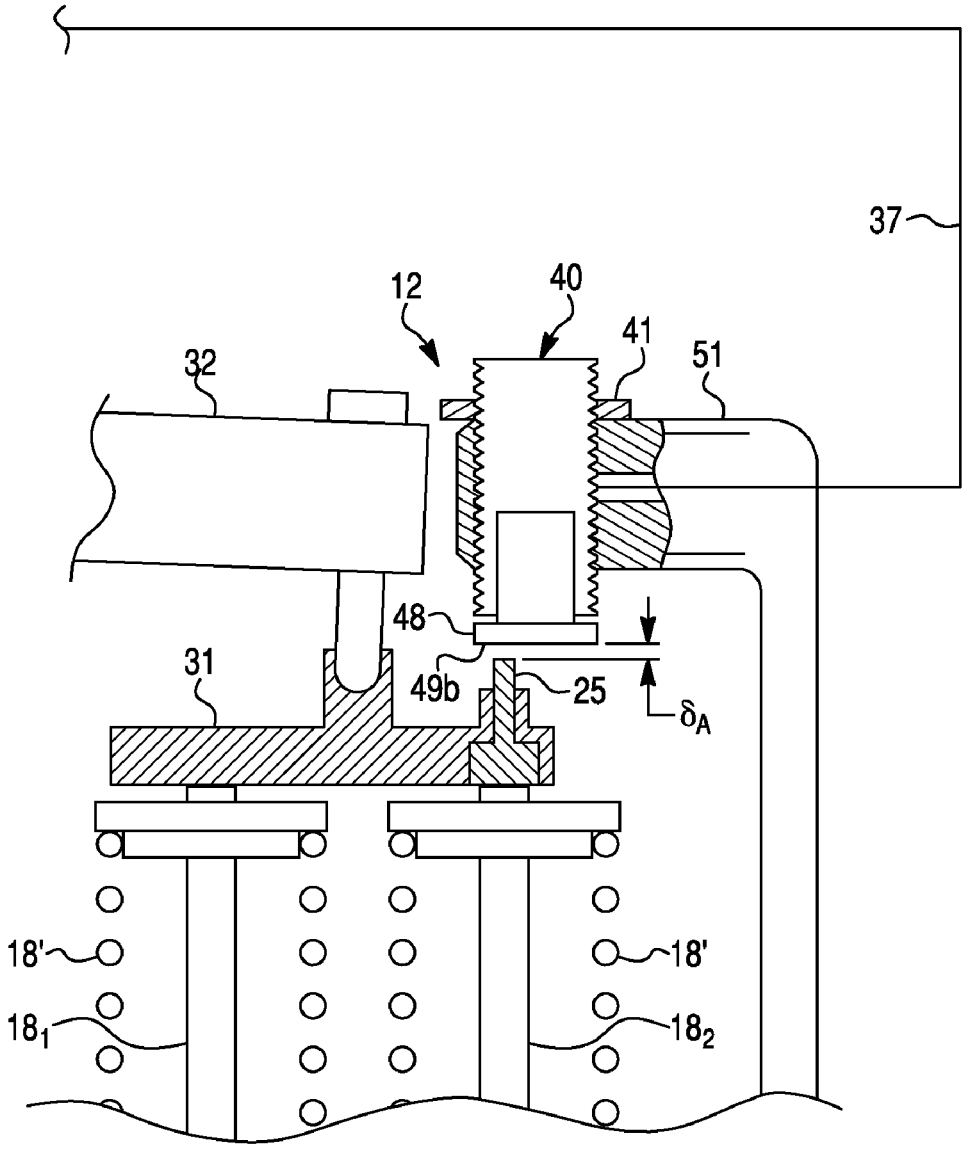
FIG. 2B is an enlarged schematic view of the portion of the compression-release brake system according to the first exemplary embodiment of the present invention with exhaust valves open by an exhaust rocker assembly.
Figure 2C:
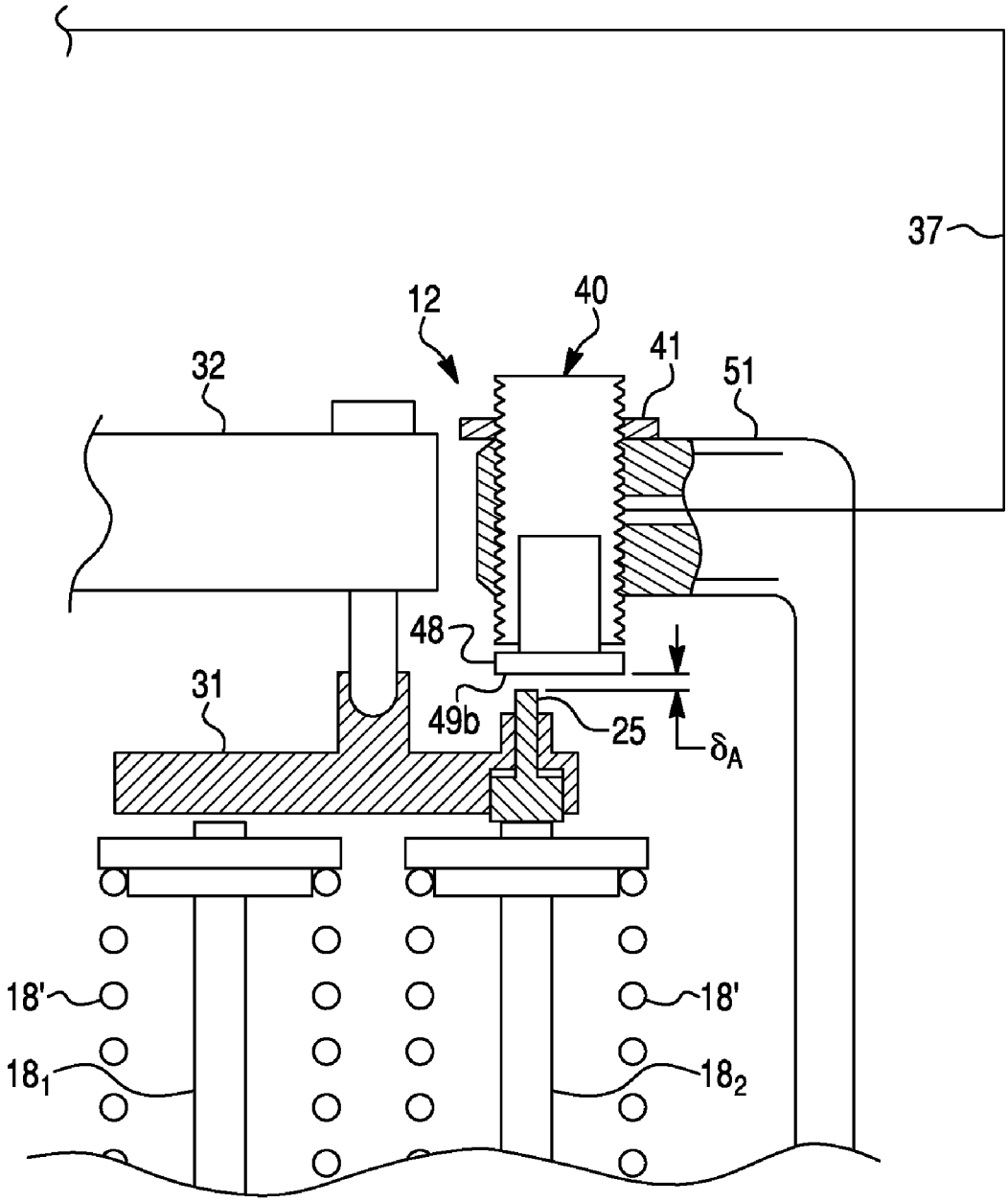
FIG. 2C is an enlarged schematic view of the portion of the compression-release brake system according to the first exemplary embodiment of the present invention with the exhaust valves floating due to backpressure in an exhaust manifold.

The compression brake control module 40 further comprises a supply/dumping conduit 60 formed within the body 42 of the casing so as to provide the pressurized hydraulic fluid from a source 34 of a pressurized hydraulic fluid to the hydraulic slave piston chamber 50 through the connecting passage 47 to extend the slave piston 48 to the extended position thereof when there is a gap $\delta_A$ between the slave piston 48 and the exhaust valve pin of the brake exhaust valve $\mathbf{18}_2$, such as when the exhaust valves 18 are open by the exhaust rocker assembly 24 (as illustrated in FIG. 2B) or when the exhaust valves 18 float due to backpressure in the exhaust manifold 20 acting to back faces of the exhaust valves 18 (as illustrated in FIG. 2C). Preferably, the source 34 of the pressurized hydraulic fluid is in the form of an engine oil pump (not shown) of the diesel engine 10. Correspondingly, in this exemplary embodiment, an engine lubricating oil is used as the working hydraulic fluid stored in a hydraulic fluid sump 35. It will be appreciated that any other appropriate source of the pressurized hydraulic fluid and any other appropriate type of fluid will be within the scope of the present invention.

Thus, the hydraulically activated compression brake control module 40 of the compression-release brake system 12 holds the exhaust valve 18 off the exhaust valve seat at a predetermined setting for the compression brake actuation mode of the I.C. engine 10.

The compression-release brake system 12 according to the first exemplary embodiment of the present invention further includes an external compression brake control valve 36 (shown in FIG. 1) provided to selectively fluidly connect the source 34 of the pressurized hydraulic fluid to the compression brake control module 40 through a compression brake fluid passageway 37. In other words, the compression brake control valve 36 is provided to selectively supply the pressurized hydraulic fluid from the source 34 to the CBCM 40 so as to switch the CBCM 40 between an activated (pressurized) condition (shown in FIG. 3) when the pressurized hydraulic fluid is supplied to the CBCM 40 and a deactivated (depressurized) condition (shown in FIG. 4) when the pressurized hydraulic fluid is not supplied to the CBCM 40. It should be understood that the compression brake fluid passageway 37 communicates with (is fluidly connected to) the supply/dumping conduit 60 of the compression brake control module 40. Preferably, the compression brake control valve 36 is an external three-way solenoid valve activated by an electromagnet (solenoid) 36' supplying the pressurized engine oil to the CBCM 40 during the compression brake actuation mode. To deactivate the compression-release brake system 12, the external three-way solenoid 36 dumps the engine oil supply back to the hydraulic fluid sump 35. As further illustrated in FIG. 1, the compression brake control valve 36 is fixed to a cylinder head 15 or cylinder block 14 of the I.C. engine 10. Thus, the compression brake control valve 36 of the compression-release brake system 12 is non-movably mounted to the I.C. engine 10.

The connecting passage 47 formed longitudinally through the separation wall 46, includes a piston opening 47*a*, an actuator opening 47*b* and an intake opening 47*c*. As illustrated in detail in FIGS. 2 and 3, the hydraulic slave piston chamber 50 fluidly communicates with the connecting passage 47 in the inner wall 46 through the piston port 47*a*, the actuator cavity 45 fluidly communicates with the connecting passage 47 through the actuator port 47*b*, and the supply/dumping conduit 60 fluidly communicates with the connecting passage 47 through the intake port 47*c*. In other words, the connecting passage 47 provides fluid communication between the slave piston chamber 50 and the actuator cavity 45 of the compression brake control module 40 and the supply/dumping conduit 60 within the body 42 of the compression brake control module 40, thus between the slave piston chamber 50 and the actuator cavity 45 and the source 34 of the pressurized hydraulic fluid.

The compression brake control module 40 further comprises a check valve 62 provided in the piston cavity 44 between the supply/dumping conduit 60 and the slave piston chamber 50 to hydraulically lock the slave piston chamber 50 when a pressure of the hydraulic fluid within the slave piston chamber 50 exceeds the pressure of the hydraulic fluid from the source 34 during the compression brake actuation mode. In other words, the check valve 62 is disposed in the slave piston chamber 50 (i.e., between the inner end face 49*a* of the piston 48 and the inner wall 46 of the casing 42 to selectively isolate and seal the slave piston chamber 50. Preferably, the check valve 62 includes a valve member, preferably in the form of a substantially spherical ball member 64 provided to seal against the piston port 47*a* of the connecting passage 47. It should be understood that an edge of the inner wall 46 forming the piston port 47*a* defines a valve seat of the ball member 64 of the check valve 62. Preferably, the ball member 64 is biased against the piston opening 47*a* of the connecting passage 47 by a biasing coil spring 66. The hydraulically activated CBCM 40 provides a seal to eliminate oil leakage from the slave piston high pressure chamber 50 and hold the slave piston 48 in the extended position without an additional return spring.

The compression brake control module 40 also comprises a hydraulic compression brake actuator 70 mounted within the actuator cavity 45 of the casing 42 and provided to selectively engage the ball member 64 of the check valve 62 when deactivated so as to unlock the slave piston chamber 50 and fluidly connect the slave piston chamber 50 to the source 34 of the pressurized hydraulic fluid, and to disengage from the ball member 64 of the check valve 62 when activated so as to lock the slave piston chamber 50 and fluidly disconnect the slave piston chamber 50 from the source 34 of the pressurized hydraulic fluid. The compression brake actuator 70 according to the first exemplary embodiment of the present invention is a hydraulic (i.e., hydraulically operated) actuator. Specifically, the compression brake actuator 70 includes a reciprocating actuator element (or master piston) 72 slidingly mounted within the casing 42 for reciprocating within the actuator cavity 45 between an extended position (shown in FIG. 4) and a retracted position (shown in FIG. 3) so that the casing 42 and the master piston 72 define a variable volume actuator chamber 74 within an innermost portion of the cylindrical actuator cavity 45 between an inner end (or bottom) face $\mathbf{72}_B$ of the master piston 72 and the inner wall 46 of the casing 42. An outer end (or top) face $\mathbf{72}_T$ of the master piston 72 is provided to engage an end cap 76 of the casing 42 in the retracted position thereof. The compression brake actuator 70 also includes a compression spring 78 acting between the master piston 72 and the end cap 76 to bias the master piston 72 downwardly toward the extended position thereof. The master piston 72 is bored so as to form a vent chamber 75 between the master piston 72 and the end cap 76 to receive the compression spring 78. The vent chamber 75 formed between the end cap 76 and the actuator element 72 is subject to atmospheric pressure through a vent port 77 provided in the end cap 76 so as to expose the outer end (or top) face $\mathbf{72}_T$ of the actuator element 172 to atmospheric pressure. The master piston 72 is adapted to reciprocate between the inner wall 46 of the casing 42 and the end cap 76. As illustrated in FIGS. 2 and 3, the master piston 72 is formed integrally with a protrusion 73 extending into the connecting passage 47 in the inner wall 46 toward the valve member 64 of the check valve 62.

Thus, the compression brake control module 40 incorporates a system to trap engine hydraulic oil in a slave piston chamber 50 above the slave piston 48 to prevent the exhaust valve 18 from returning to the valve seat at the end of the compression stroke. The system assures an absolute minimum trapped oil volume to minimize the bulk modulus compressibility of the trapped oil in the slave piston chamber 50. The compression brake control module 40 is attached to the engine 10 (preferably to a cylinder head) through an attaching hardware that incorporates a stiff mounting hold-down to minimize mechanical hardware flexibility during engine braking operation. Incorporation of minimum oil compliance and hardware deflections provides predictable and optimal engine brake retarding performance. The present invention also provides a miniature compression brake control module 40 housing package.

The compression-release brake system 12 of the I.C. engine 10 can be used in conjunction with a fixed orifice exhaust brake, a pressure regulated exhaust brake or a variable geometry turbocharger (VGT) to incorporate two cycle engine braking. The combination uses the compression and exhaust strokes to produce a quieter system with reduced engine valve train loading while yielding excellent brake retarding power. Thus, the diesel engine 10 further comprises a turbocharger 80 including a compressor 82 and a turbine 83, and a variable exhaust brake 84 fluidly connected to the turbocharger 80 through an exhaust passage 21. As illustrated in FIG. 1, the compressor 82 is in fluid communication with the intake manifold 19 through an intake conduit 38, while the turbine 83 is in fluid communication with the exhaust manifold 20 through an exhaust conduit 39. Conventionally, the exhaust gases from the exhaust manifold 20 rotate the turbine 83 and exit the turbocharger 80 through the exhaust conduit 39 into the exhaust brake 84. In turn, ambient air compressed by the compressor 82 is carried by the intake conduit 38 to the intake manifold 19 through an intercooler 81 where the compressed charge air is cooled before entering the intake manifold 19. The charge air enters the cylinder 14 through the intake valve 17 during an intake stroke. During an exhaust stroke, the exhaust gas exits the cylinder 14 through the exhaust valve 18, enters into the exhaust manifold 20 and continues out through the turbine 83 of the turbocharger 80.

As illustrated in FIG. 1, the exhaust brake 84 of the first exemplary embodiment of the present invention is located downstream of the turbocharger 80. However, the location of the exhaust brake 84 is not limited to downstream of the turbine 83 or to the form of a conventional exhaust brake. Alternatively, the exhaust brake 84 may be placed upstream of the turbocharger 80 (the turbine 83). Where the exhaust brake 84 is installed upstream of the turbocharger 80, advantage is taken by generating a high-pressure differential across the turbine 83. This drives the turbocharger compressor 82 to a higher speed and thereby provides more intake boost to charge the cylinder for engine braking.

In accordance with the present invention illustrated in FIG. 1, the exhaust brake 84 includes a variable exhaust restrictor in the form of a butterfly valve 85 operated by an exhaust brake actuator 86. Preferably, the butterfly valve 85 is rotated by linkage 85' connected to the exhaust brake actuator 86 in order to adjust the exhaust restriction, thus the amount of exhaust braking. The exhaust brake actuator 86 of the present invention may be of any appropriate type known to those skilled in the art, such as a fluid actuator (pneumatic or hydraulic), an electromagnetic actuator (e.g. solenoid), an electromechanical actuator, etc. Preferably, in this particular example, the exhaust brake actuator 86 is a pneumatic actuator, although, as noted above, other actuating devices could be substituted.

The exhaust brake actuator 86 is controlled by a microprocessor (or exhaust brake electronic controller) 87. The microprocessor 87 controls the variable exhaust restrictor 85, thus the amount of exhaust braking, based on the information from a plurality of sensors 88 including, but not limited, an pressure sensor and a temperature sensor sensing pressure and temperature of the exhaust gas flowing through the exhaust restrictor 85 of the exhaust brake 84. It will be appreciated by those skilled in the art that any other appropriate sensors, may be employed. The pneumatic actuator 86 is operated by a solenoid valve 89 provided to selectively connect and disconnect the pneumatic actuator 86 with a pneumatic pressure source (not shown) through a pneumatic conduit 89' in response from a control signal from the microprocessor 87.

The compression-release brake system 12 according to the first exemplary embodiment of the present invention is controlled by an electronic controller 90 (as illustrated in FIG. 1), which may be in the form of a CPU or a computer. The electronic controller 90 operates the electromagnetic compression brake control valve 36 based on the information from a plurality of sensors 92 representing engine and vehicle operating parameters as control inputs, including, but not limited to, an engine speed, an engine load, an engine operating mode, etc. It will be appreciated by those skilled in the art that any other appropriate sensors, may be employed. The electronic controller 90 is programmed to provide a signal 94 to the solenoid 36 of the external three-way control valve 36 to cause them to selectively and independently open or close based on operating demand of the engine 10. When the compression brake control valve 36 is open, pressurized hydraulic fluid, such as pressurized engine oil, is provided to the hydraulic compression brake actuator 70 of the compression brake control module 40 and the I.C. engine 10 operates in the compression brake mode (engine brake cycle). Correspondingly, when the solenoid compression brake control valve 36 is closed, no pressurized hydraulic fluid is supplied to the hydraulic compression brake actuator 70 of the compression brake control module 40 and the I.C. engine 10 operates in the normal engine cycle.

The exhaust brake 84 reads exhaust system pressure and temperature from the sensors 92 at the microprocessor 90 and regulates a signal 89 to the exhaust brake actuator 86 that adjusts the variable exhaust restrictor 85. The electronic controller 90 also provides a signal 96 to the microprocessor 87 of the exhaust brake 84. When the engine 10 is operating in engine brake mode, the control signal 96 adjusts the variable exhaust restrictor 85 in order to maintain a desired exhaust backpressure.

The braking operation of the I.C. engine 10 of the present invention has two integral components: a compression release (weeper) braking provided by the compression-release brake system 12, and an exhaust braking provided by the exhaust brake 84. The compression release braking component is provided by action of the compression brake control module 40 of the compression-release brake system 12, while the exhaust braking is provided by the exhaust brake 44.

The operation of the compression-release brake system 12 is described in detail below.

When the engine 10 performs positive power operation (i.e., operates in the normal engine cycle), the compression brake control valve 36 is closed and the hydraulic compression brake control module 40 is in the depressurized condition so that no hydraulic fluid is supplied to the compression brake control module 40, and the slave piston chamber 50 is filled with the hydraulic fluid but not the pressurized hydraulic fluid. In such a condition, shown in FIG. 3, the master piston 72 is moved to and supported in the extended position thereof (only by the biasing force of the compression spring 78). In this position, the protrusion 73 of the master piston 72 displaces the ball member 64 of the check valve 62 away from the valve seat thereof by overcoming the biasing force of the spring 66 of the check valve 62, which is lighter than the biasing force of the compression spring 78 of the compression brake actuator 70. Moreover, when the compression brake control valve 36 is closed, the slave piston chamber 50 is completely filled with the engine oil during the normal exhaust stroke when the exhaust valves 18 are lifted off their valve seats by the normal exhaust cam profile.

During the engine braking operation, when it is determined by the electronic controller 90 based on the information from the plurality of sensors 92 that the braking is demanded, such as when a throttle valve (not shown) of the engine 10 is closed, the exhaust brake 84 is actuated by at least partially closing the butterfly valve 85 in order to create a backpressure resisting the exit of the exhaust gas during the exhaust stroke. Moreover, during the engine braking operation, the electronic controller 90 opens the compression brake control valve 36 to turn on the supply of the pressurized hydraulic fluid to the compression brake control module 40, thus setting the compression brake control module 40 to the pressurized condition. When the pressurized engine oil is supplied to the supply/dumping conduit 60 of the compression brake control module 40, the master piston 72 of the compression brake actuator 70 is forced outward by the supply oil pressure allowing the check ball 64 to be seated. At the same time, the pressurized hydraulic fluid will flow into the slave piston chamber 50. As the pressurized supply oil fills the slave piston chamber 50, the pressure of the supply oil forces the slave piston 48 outwardly until the slave piston 48 contacts the mechanical stop (in the form of the snap ring 58), as shown in FIG. 3, when the exhaust valves 18 are off the valve seat during the normal exhaust valve lift. The spring loaded check ball 64 will lock the oil above the slave piston 48 and prevent the slave piston 48 from returning to the collapsed position thereof (shown in FIG. 4). This provides extended lift and phase angle for the brake exhaust valve $\mathbf{18}_2$. The extended open duration lift of the brake exhaust valve $\mathbf{18}_2$ forms a bleeder (weeper) opening during the engine compression stroke, and the engine 10 performs non-recoverable work as gas is forced out of the cylinder through this opening, which embodies the compression-release brake.

In a position illustrated in FIG. 3, the slave piston 48 is locked in place by the trapped oil in the slave piston chamber 50, and stops one of the exhaust valves 18 from returning to the valve seat. The location of the slave piston stop 58, the stroke limiting slot 54 and the install position of the compression brake control module 40, determines the amount of distance that the exhaust valve 18 will be held off the valve seat, resulting in a predetermined lift during the complete engine braking cycle. The oil in the slave piston chamber 50 is hydraulically locked by the ball check valve 62 located above the slave piston 48 to hold the slave piston 48 in the extended position. At the completion of the normal exhaust valve motion, the extended slave piston 48 stops the exhaust valve 18 from returning to the valve seat and thereby holds the exhaust valve open for a desired lift and time of the compression-release brake system 12.

When the engine braking mode is deactivated, the solenoid valve 36 is turned off to cut out the pressurized oil supply to the compression brake control module 40, thereby resulting in the compression spring 78 forcing the actuation piston 72 toward the ball check valve 62, which unseats the ball member 64 from its seated position. The released oil flows out the slave piston chamber 50 through the external three way solenoid valve 36 and back to an oil sump 35, shown in FIG. 1. The slave piston 48 is then forced back to the collapsed position (shown in FIG. 3) in the piston cavity 44 of the casing 42 by the force of the exhaust valve springs 18'. The exhaust valve 18 returns to the valve seat to allow for normal engine valve motion.

The compression-release brake system 12 with the hydraulically activated compression brake control module 40 holds the exhaust valve 18 off the exhaust valve seat at a predetermined setting for the complete engine brake cycle (weeper brake event). The compression-release brake system 12 can be used in conjunction with a fixed orifice exhaust brake, a pressure regulated exhaust brake or a VGT turbocharger to incorporate two cycle engine braking. The combination uses the compression and exhaust strokes to produce a quieter system with reduced engine valve train loading while yielding excellent brake retarding power.

The compression-release brake system 12 used in combination with the pressure regulated exhaust brake 84 provides advantages over using a compression-release brake system with a fixed orifice exhaust brake. When a compression-release brake and exhaust brake combination is designed for maximum exhaust backpressure and the compression-release brake component fails to function for any reason the typical extended exhaust/intake valve overlap condition will be eliminated. The elimination of the extended valve overlap results in much higher exhaust manifold pressures and the engine can experience unacceptable valve seating velocities which can result in major engine damage and excessive valve seat wear.

Major engine damage can result from valve seat damage or valve spring failure. Valve spring failure can cause engine valves to drop into the combustion chamber and can cause progressive engine damage. Valve seat damage can progress because the exhaust valve will not adequately seal compression pressures and/or not provide good heat transfer from the exhaust valve to the cylinder head during high positive power engine loading.

The pressure regulated exhaust brake that is used in combination with the compression-release brake system has the advantage that the exhaust brake can be used alone on a combination compression-release/exhaust brake engine with no possibility of over-pressurizing the exhaust manifold and thereby avoiding excessive valve floating and unacceptable valve seating velocities. Because the pressure regulated exhaust brake is self-regulating, over-pressurization of the exhaust manifold cannot occur because the restriction orifice in the exhaust brake increases in area automatically to maintain a highest constant exhaust manifold pressure in compliance with engine manufacture specifications.

Figure 5:
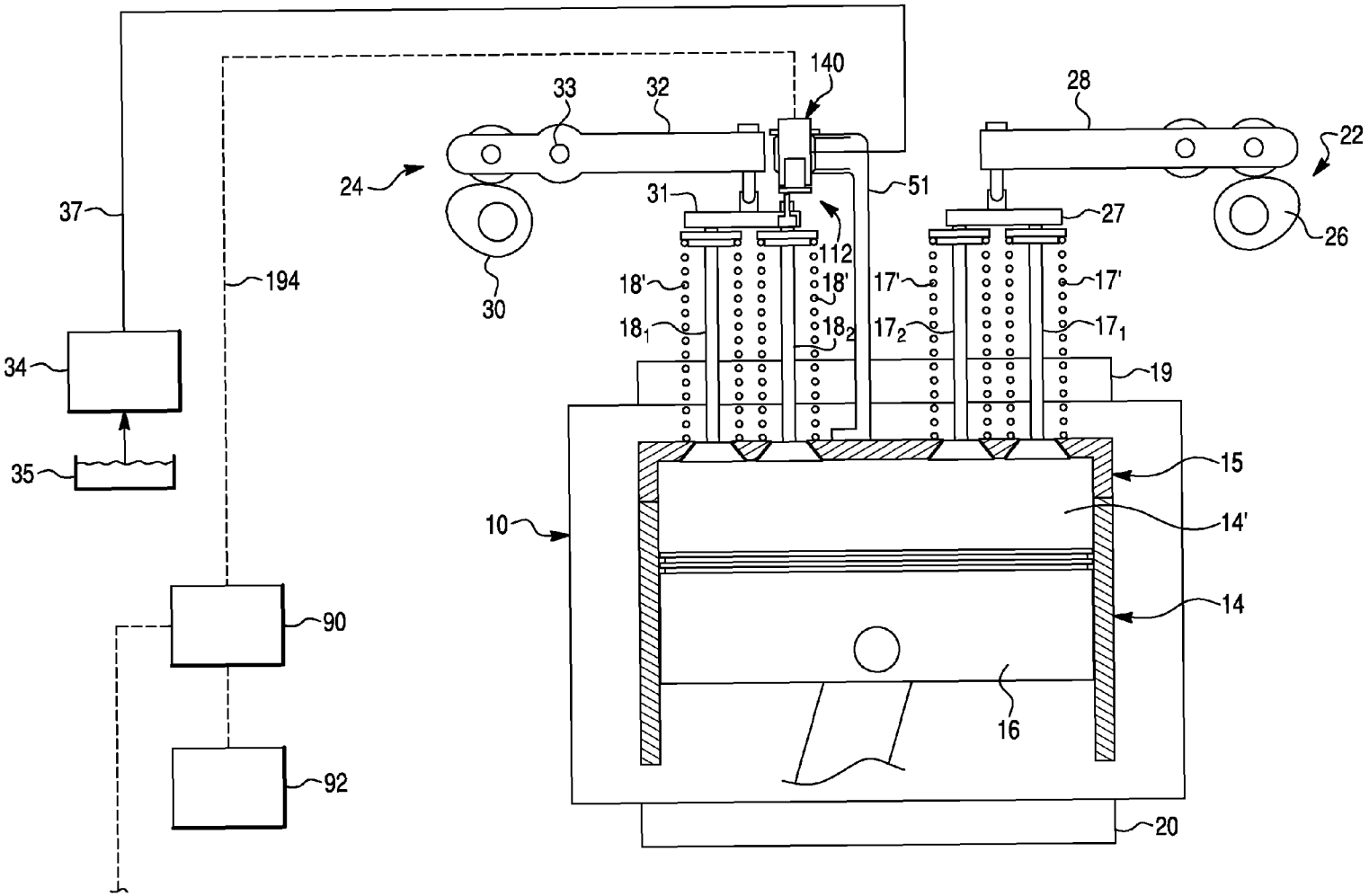
FIG. 5 is a schematic view of the internal combustion engine including a compression-release brake system according to a second exemplary embodiment of the present invention.
Figure 6:
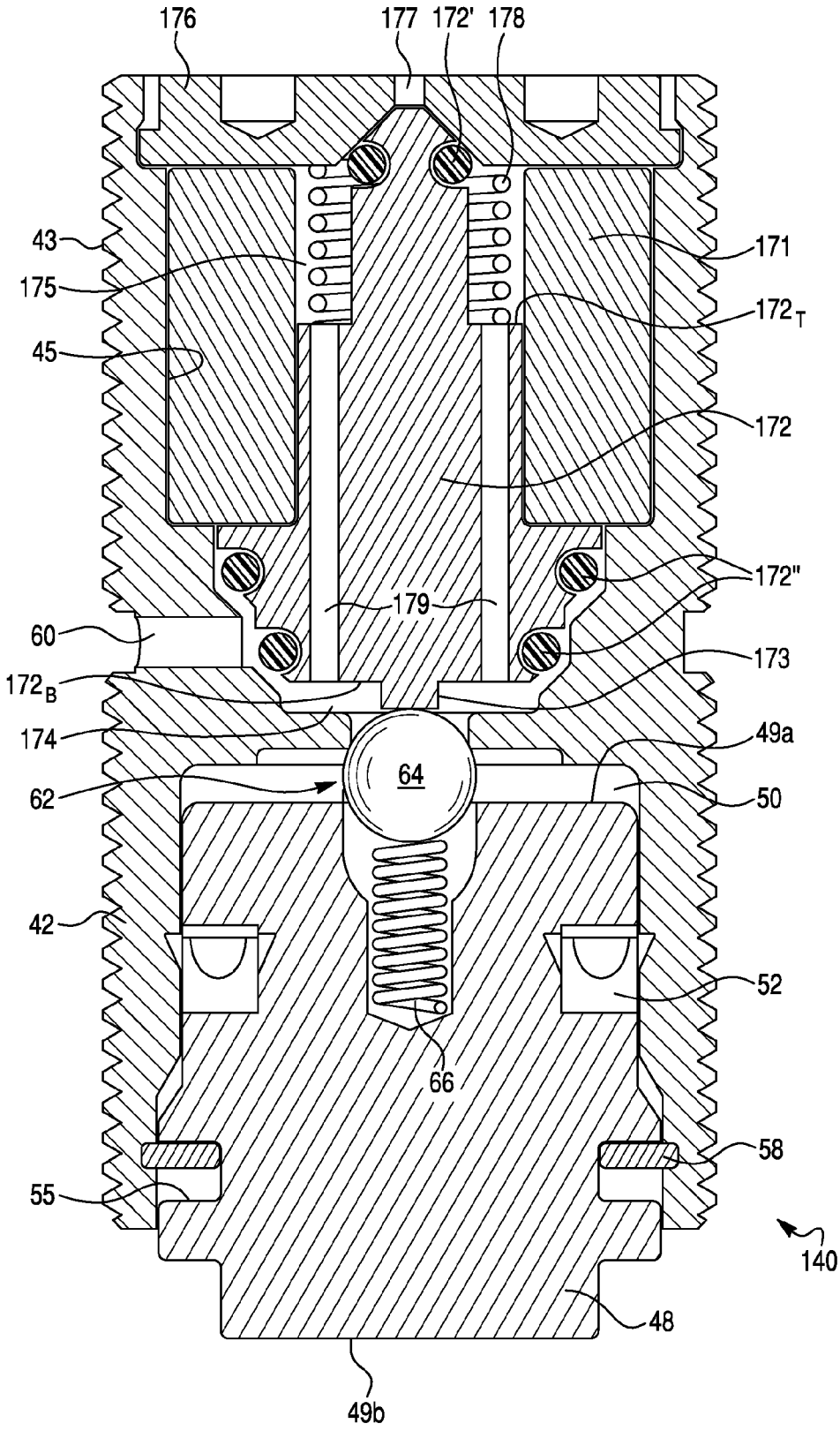
FIG. 6 is a sectional view of an electrically actuated compression brake control module of the compression-release brake system according to the second exemplary embodiment of the present invention in a depressurized condition.
Figure 7:
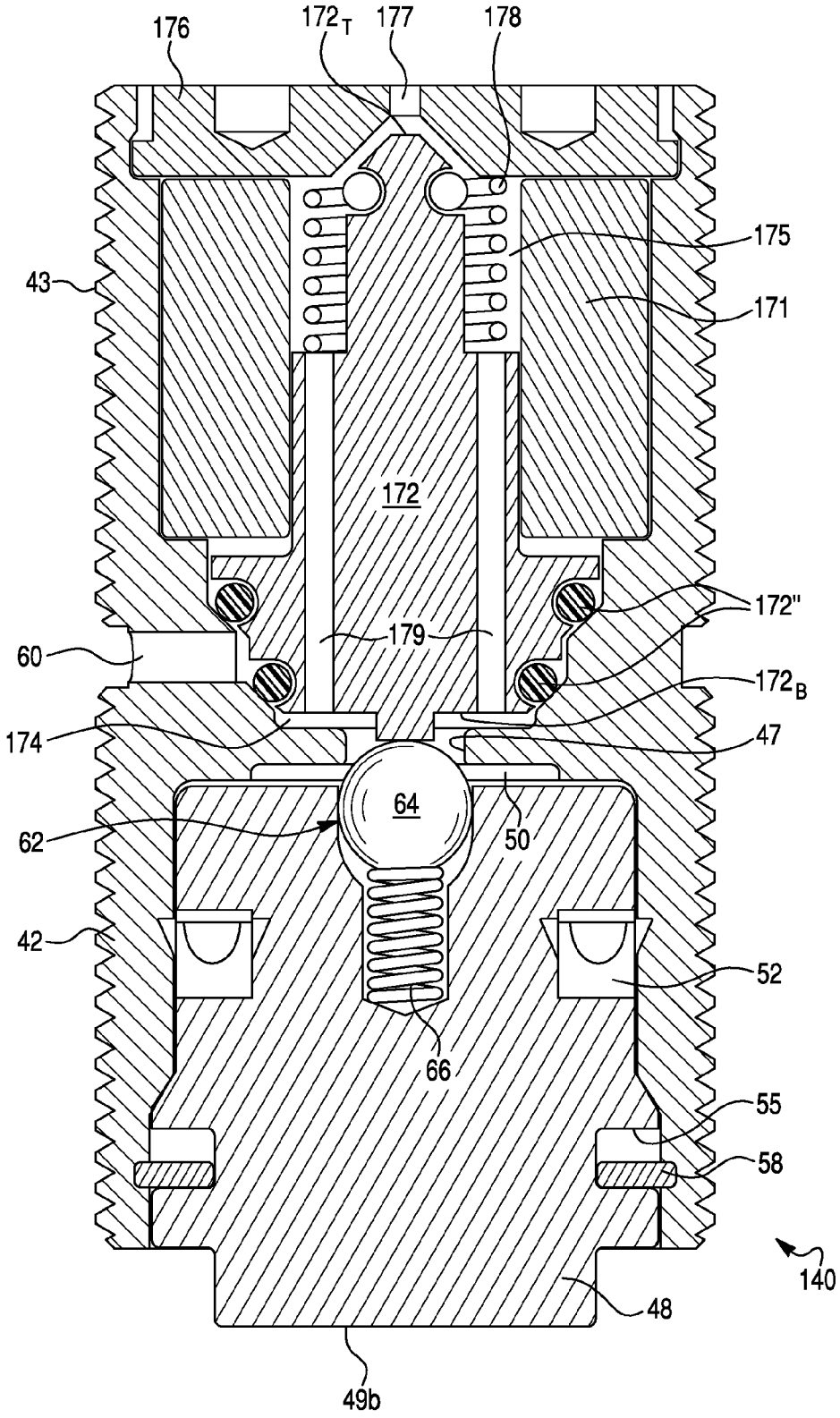
FIG. 7 is a sectional view of the electrically actuated compression brake control module of the compression-release brake system according to the second exemplary embodiment of the present invention in a pressurized condition.

FIGS. 5-7 illustrate a second exemplary embodiment of a compression-release brake system, generally depicted by the reference character 112, provided for an internal combustion (IC) engine 10. Components, which are unchanged from the first exemplary embodiment of the present invention, are labeled with the same reference characters. Components, which function in the same way as in the first exemplary embodiment of the present invention depicted in FIGS. 1-4 are designated by the same reference numerals to some of which 100 has been added, sometimes without being described in detail since similarities between the corresponding parts in the two embodiments will be readily perceived by the reader.

The main difference of the compression-release brake system 112 of FIGS. 5-7 with respect to the compression-release brake system 12 of FIGS. 1-4 is that a compression brake control module 140 of the compression-release brake system 112 according to the second exemplary embodiment of the present invention includes an electromagnetic (solenoid) compression brake actuator 170 located within a actuator cavity 45 of a casing 42 and provided to selectively engage a ball member 64 of a check valve 62 when deactivated so as to unlock a hydraulic slave piston chamber 50 and fluidly connect the slave piston chamber 50 to a source 34 of the pressurized hydraulic fluid, and to disengage from the ball member 64 of the check valve 62 when activated so as to lock the slave piston chamber 50 and fluidly disconnect the slave piston chamber 50 from the source 34 of the pressurized hydraulic fluid. Moreover, as illustrated in FIG. 5, the compression-release brake system 112 with the electrically actuated compression brake control module 140 does not require an additional external solenoid valve to supply and turn on and off pressurized oil supply, unlike the compression-release brake system 12 according to the first exemplary embodiment of the present invention having the solenoid compression brake control valve 36. In other words, the CBCM 140 of the compression-release brake system 112 of the second exemplary embodiment of the present invention is constantly supplied with the pressurized engine oil.

The compression brake actuator 170 according to the second exemplary embodiment of the present invention is an electric (i.e., electrically operated) actuator. Specifically, the compression brake actuator 170 includes a solenoid coil 171 fixed to an inner peripheral surface of the cylindrical actuator cavity 45 of the casing 42 and an armature (or actuator element) 172 slidingly mounted within the solenoid coil 171 for reciprocating within the actuator cavity 45 between an extended position (shown in FIG. 5) and a retracted position (shown in FIG. 4) so that the casing 42 and the armature 172 define a variable volume actuator chamber 174 within an innermost portion of the cylindrical actuator cavity 45 between an inner end (or bottom) face $\mathbf{172}_B$ of the armature 172 and the inner wall 46 of the casing 42. Thus, the solenoid coil 171 and the armature 172 define an internal solenoid of the CBCM 140 of the compression-release brake system 112. An outer end of the armature 172 is provided to engage an end cap 176 in the retracted position thereof. A vent chamber 175 formed between the end cap 176 and the actuator element 172 is subject to atmospheric pressure through a vent port 177 provided in the end cap 176 so as to expose an outer end (or top) face $\mathbf{172}_T$ of the actuator element 172 to atmospheric pressure. The armature 172 is also provided with fluid conduits 179 there through fluidly connecting the actuator chamber 174 with the vent chamber 175 in order to dump the excess oil from the slave piston chamber 50 and/or the actuator chamber 174 to the vent chamber 175.

The armature 172 is provided with an O-ring seal 172' for sealing the vent port 177, and O-ring seals 172" for sealing the actuator chamber 174. The compression brake actuator 170 also includes a compression spring 178 acting between the armature 172 and the end cap 176 to bias the armature 172 toward the extended position thereof. The armature 172 is adapted to reciprocate between the inner wall 46 of the casing 42 and the end cap 176. In other words, the solenoid compression brake actuator 170 is provided to switch the CBCM 140 between an activated (or "On") condition (shown in FIG. 6) when solenoid actuator 170 is energized (i.e., the solenoid coil 171 is supplied with the electric current) and the check valve 62 is closed, and a deactivated (or "Off") condition (shown in FIG. 7) when solenoid actuator 170 is de-energized (i.e., the solenoid coil 171 is not supplied with the electric current) and the check valve 62 is open (the armature 172 is moved to the extended position only due to the biasing force of the compression spring 178). As illustrated in FIGS. 6 and 7, the armature 172 is formed integrally with a protrusion 173 extending into the connecting passage 47 in the inner wall 46 toward the valve member 64 of the check valve 62.

During brake-on operation the compression brake actuator 170 of the CBCM 140 is controlled by an electronic controller (ECU) 90 based on the information from a plurality of sensors 92 representing engine and vehicle operating parameters as control inputs, including, but not limited to, an engine speed, an engine load, an engine operating mode, etc., switching the internal solenoid coil 171 off and on. The solenoid brake actuator 170 will be power on after the normal exhaust valve closing and be powered off after the start of the expansion stroke.

When the engine 10 performs positive power operation (i.e., operates in the normal engine cycle), the solenoid compression brake actuator 170 is de-energized (i.e., the solenoid coil 171 of the solenoid actuator 170 is not supplied with the electric current) so that the armature 172 is in the extended position (shown in FIG. 5) only due to the biasing force of the compression spring 178. In this position, the protrusion 173 of the armature 172 displaces the ball member 64 of the check valve 62 away from the valve seat thereof by overcoming the biasing force of the spring 66 of the check valve 62, which is lighter than the biasing force of the compression spring 178 of the compression brake actuator 170. Moreover, the biasing force of the compression spring 178 is strong enough to overcome the force of the pressurized engine oil trying to move the armature 172 toward the retracted position thereof. It should be understood that the slave piston chamber 50 is completely filled with the engine oil during the normal exhaust stroke when the exhaust valves 18 are lifted off their valve seats by the normal exhaust cam profile. In other words, when the solenoid compression brake actuator 170 is de-energized, the CBCM 140 is in the depressurized condition so that although the pressurized hydraulic fluid is supplied to the CBCM 140 by the source 34, the slave piston chamber 50 is filled with the hydraulic fluid but not the pressurized hydraulic fluid.

In operation, the engine oil supply is continuously supplied to the compression brake control module 140. When the internal solenoid actuator 170 of the CBCM 140 is energized, the solenoid armature 170 is pulled to its retracted position (shown in FIG. 4) away from the ball member 64 of the check valve 62 to allow the pressurized engine supply oil to fill the hydraulic slave piston chamber 50 and force the slave piston 48 to the stroke limiting mechanical stop 58 in the CBCM 140 during the normal exhaust valve lift. The ball member 64 of the check valve 62 locks the oil above the slave piston 48, preventing the slave piston 48 from returning. The slave piston 48 is locked in place by the trapped oil in the hydraulic slave piston chamber 50, which prevents the exhaust valves from returning to the valve seats. The location of the slave piston stop 58, piston stroke limiting feature and the slave piston lash adjustment determine the amount of distance that exhaust valves are held off the valve seats for the compression-release braking event.

Figure 8:
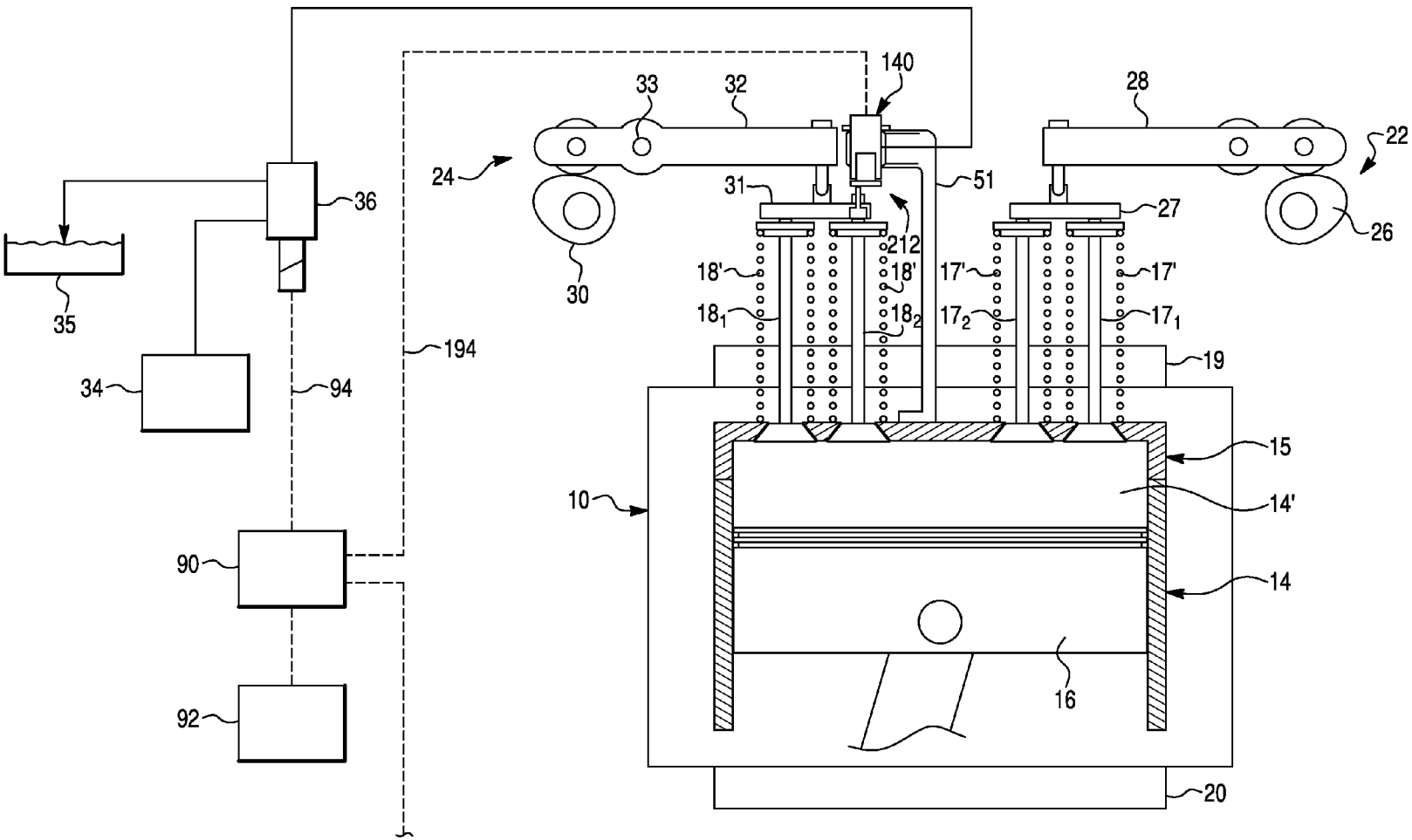
FIG. 8 is a schematic view of the internal combustion engine including a compression-release brake system according to a third exemplary embodiment of the present invention.

FIG. 8 illustrates a third exemplary embodiment of a compression-release brake system, generally depicted by the reference character 212, provided for an internal combustion (IC) engine 10. Components, which are unchanged from the first exemplary embodiment of the present invention, are labeled with the same reference characters. Components, which function in the same way as in the second exemplary embodiment of the present invention depicted in FIGS. 5-7 are designated by the same reference numerals to some of which 100 has been added, sometimes without being described in detail since similarities between the corresponding parts in the two embodiments will be readily perceived by the reader.

The main difference of the compression-release brake system 212 of FIG. 8 with respect to the compression-release brake system 112 of FIGS. 5-7 is that the compression-release brake system 212 according to the third exemplary embodiment of the present invention includes a compression brake control valve 36 provided to selectively fluidly connect the source 34 of the pressurized hydraulic fluid to the compression brake control module 140 through a compression brake fluid passageway 37. In other words, the compression brake control valve 36 is provided to selectively supply the pressurized hydraulic fluid from the source 34 to the CBCM 140 through the compression brake fluid passageway 37. It should be understood that the compression brake fluid passageway 37 communicates with (is fluidly connected to) the supply/dumping conduit 60 of the compression brake control module 40. Preferably, the compression brake control valve 36 is an external three-way electromagnet (solenoid) supplying the pressurized engine oil to the CBCM 140 during the compression brake actuation mode. Thus, the third exemplary embodiment of the present invention provides a timed electronically controlled compression-release brake system 212.

The timed electronically controlled compression-release brake system 212 utilizes the external three-way solenoid valve 36 (i.e., exterior to the CBCM 140) to supply and dump the pressurized engine oil applied in combination with the internal solenoid actuator 170 of the CBCM 140 to control the on/off engine brake function. To activate the engine brake, electrical power is supplied to both the internal solenoid actuator 170 of the CBCM 140 and the external three-way solenoid valve 36. The external solenoid valve 36 supplies the CBCM 140 with low pressure engine oil and the internal solenoid actuator 170 of the CBCM 140 allows closing and opening of the check valve 62 to control the timed compression-release brake cycle. The electronically controlled timed compression-release brake system 212 of the invention improves engine braking performance over non-timed hydraulically controlled compression-release engine brake system 12. The timed compression-release brake event requires the electric power supplied to the internal solenoid actuator 170 integrated into the CBCM 140. The solenoid actuator 170 is energized and de-energized during each engine cycle to control the engine brake valve opening and closing events.

The timed compression-release brake system 212 holds the exhaust valve off the valve seat during the compression stroke, and de-energizes the solenoid actuator 170 during the beginning of the expansion stroke, closing the exhaust (brake) valve opening. This valve closing results in a stopping of exhaust manifold air to flow into the cylinder 14, thereby reducing cylinder pressure at the end of the expansion stroke, and causing additional piston work.

Closing the exhaust (compression brake) valve opening prior to the exhaust/intake valve overlap event prevents the exhaust/intake event from being extended. With an extended exhaust/intake valve overlap the higher pressure in the exhaust manifold forces exhaust manifold air back into the combustion chamber during the intake stroke and out through the open intake valve 17, thereby reducing exhaust manifold air mass and backpressure. Eliminating the extended exhaust/intake valve overlap provides a higher average exhaust manifold pressure, creating additional work done by the piston during the exhaust stroke.

Just after the beginning of the intake stroke, the electronic controller 90 of the timed compression-release brake system 212 triggers power to the external solenoid valve 36 and the internal solenoid actuator 170, thereby providing pressurized engine oil to the slave piston chamber 50. The slave piston 48 extends to a position of contact with the exhaust valve pin 25 but cannot open the brake exhaust valve $\mathbf{18}_2$ because the exhaust valve $\mathbf{18}_2$ is biased closed by the engine exhaust valve spring 18'. Near the end of intake stroke the pressure in the cylinder 14 is low and the pressure in the exhaust manifold 20 is high, due to the exhaust brake 84, resulting in the greatest pressure differential across the exhaust valves 18. This pressure differential causes the exhaust valves 18 to float off their valve seats forming a gap $\delta_A$ between the slave piston 48 and the exhaust valve pin 25 of the brake exhaust valve $\mathbf{18}_2$, as illustrated in FIG. 2B. Furthermore, as the exhaust valve 18 floats forming the gap $\delta_A$ between the CBCM 140 and the exhaust valve pin 25, the slave piston 48 of the CBCM 140 is further expanded to its fully extended position to close this gap between the exhaust valve pin 25 and the CBCM 140 by moving the slave piston 48 downwardly, from the position shown in FIG. 7, to its extended position shown in FIG. 6 so that the additional amount of the pressurized hydraulic fluid enters through the supply conduit 60 and fills the slave piston chamber 50. Accordingly, the length of the CBCM 140 increases.

During the exhaust valves 18 float near the end of the intake stroke, the slave piston 48 of the CBCM 140 will continue to the mechanical stop position and the engine oil will be locked in the slave piston chamber 50 by the ball check valve 62. The slave piston 48 stops the floating brake exhaust valve $\mathbf{18}_2$ from returning to its valve seat. The brake exhaust valve $\mathbf{18}_2$ is held off its valve seat by the extended slave piston 48 a preset lift amount during compression stroke. After completion of the compression stroke, the cycle is completed.

After the start of the expansion stroke, the electronic controller 90 of the timed compression-release brake system 212 triggers the power to the external solenoid valve 36 and the internal solenoid actuator 170 to be shut off. The slave piston 48 retracts and the brake exhaust valve $\mathbf{18}_2$ is fully closed until the cycle repeats itself just after the beginning of the intake stroke.

The electronic package required for the electronic timed compression-release/exhaust combination brake provides additional engine retarding power. The timed compression-release/exhaust combination brake system of the invention is able to satisfy heavy duty vehicle applications that require higher retarding power than a non-timed compression-release/exhaust combination brake system.

The oil supply requires the external three way solenoid valve 36 to be energized when engine brake is switched on to supply oil to the CBCM 140. During brake-on operation the timed compression-release brake system 212 can be controlled by the electronic controller 90 switching the internal solenoid actuator 170 of the CBCM 140 off and on. The internal solenoid actuator 170 will be powered on after the normal exhaust valve closing and be powered off after the start of the expansion stroke. The exhaust brake must be on and develop enough exhaust manifold pressure to float the exhaust valves 18 during the engine braking speed range. To start the exhaust valve weeper event the internal solenoid actuator 170 can be energized by the electronic controller 90 after the closing of the exhaust valves 18 allowing the ball check 64 to return to its seat. During the exhaust valve float near the ending of the inlet stroke the exhaust valve floating will permit the slave piston 48 to move downward allowing the slave piston chamber 50 to be filled and contact the mechanical stop 58, lock in oil and hold off the brake exhaust valve $\mathbf{18}_2$ from returning to the valve seat to for next weeper brake cycle.

The fail safe spring 66 will lift the ball member 64 off its seat when the internal solenoid 170 is powered off, releasing the oil in the slave piston chamber 50 back into the oil supply to allow the exhaust valve(s) 18 to return to their valve seat. Next the electronic controller 90 signals for powering the internal solenoid 170 and cycle starts again.

The operation of the timed compression-release brake system 212 is described in detail below.

The timed compression-release brake system 212 requires the electronic controller 90 to time the electrical actuation signal to energize and de-energize the internal solenoid actuator 170 of the CBCM 140. The supply oil pressure is supplied by the external three way solenoid valve 36 to supply to the inlet port 60 of the CBCM 140 when the engine brake is activated. The integrated solenoid of the CBCM 140 controls the opening and closing of the ball check valve 62 during weeper brake activation and deactivation. The ball check valve 62 locks the oil in the slave piston chamber 50, preventing the slave piston 48 from returning. The slave piston 48 is locked in place by the trapped oil in the slave piston chamber 50, which prevents the brake exhaust valve $\mathbf{18}_2$ from closing. The location of the slave piston stop 58, piston stroke limiting feature and the slave piston lash adjustment determine the amount of distance that the brake exhaust valve $\mathbf{18}_2$ is held off the valve seat for the weeper braking event.

In a timed weeper brake system 212, an electronic trigger mechanism energizes and de-energizes the internal solenoid 171, 172 of the CBCM 140 to shut the exhaust valve lift of the weeper brake just after the start of the expansion stroke of the engine 10 to eliminate any increase in the normal engine exhaust/intake valve overlap condition. The closed exhaust valve 18, prior to the intake stroke, eliminates the increased valve overlap condition which occurs on the non-timed weeper brake system 112 where the weeper brake holds the exhaust valve 18 open for the entire engine braking event. The condition of increased overlap on the non-timed weeper brake allows exhaust air mass to flow from the exhaust manifold 20 into the cylinder 14' and then out the intake valve 17 into the inlet manifold 19. This considerable loss of air mass in the exhaust manifold prohibits obtaining the maximum desired exhaust manifold pressure. In the timed weeper engine brake system 212 of the present invention, engine retarding power is increased by the increased work done during the exhaust stroke. The higher retarding power results from the increased exhaust manifold pressure and the additional negative work done on the expansion stroke by closing the exhaust valve 18 at the beginning of the expansion stroke.

In the timed weeper brake system 212, just after the start of the engine intake stroke an electronic trigger mechanism causes power to be applied to the internal solenoid 171, 172 integrated into the CBCM 140. The external three-way solenoid valve 36 supplies pressurized engine oil to the oil supply port 60 of the CBCM 140 continuously during brake activation, and the internal solenoid coil 171 pulls in the armature 172 to allow the ball check valve 62 to seal the slave piston chamber 50. The supply oil pressure forces the slave piston 48 against the exhaust valve pin 25 and brake exhaust valve $\mathbf{18}_2$. The exhaust valve spring 18' prevents the slave piston 48 from opening the brake exhaust valve $\mathbf{18}_2$. With the combination exhaust brake operating, the exhaust brake orifice is sized to float the exhaust valves 18 off the valve seats a predetermined amount. The exhaust valve float occurs near bottom dead center (BDC) of the intake stroke because the differential pressure across to exhaust valve 18 is greatest at that time. During the exhaust valve float the slave piston 48 can fully extend because of the elimination of the valve spring force from the slave piston 48. When the exhaust valve 18 floats back towards the valve seat, the extended slave piston 48 holds the brake exhaust valve $\mathbf{18}_2$ off the valve seat the predetermined weeper brake opening. The weeper brake opening is held open for the full duration on the compression stroke. Just after top dead center (TDC) compression stroke, an electronic trigger mechanism causes the brake exhaust valve $\mathbf{18}_2$ to close and the weeper braking cycle repeats.

When the engine braking mode is deactivated, the external solenoid valve 36 releases the pressurized supply oil back to the sump 35 and the internal solenoid actuator 170 of the CBCM 140 is also deactivated causing the spring loaded armature 172 to force the ball member 64 of the check valve 62 off the seat releasing the oil from the slave piston chamber 50. The released oil will flow out the supply port 60 and through the external solenoid valve 36 back to the oil sump 35. The slave piston 48 will now be forced back to the collapsed position in the casing 42 by the exhaust valve spring 18'. The brake exhaust valve $\mathbf{18}_2$ will now be allowed to return to the valve seat to allow for normal engine valve motion.

Figure 9:
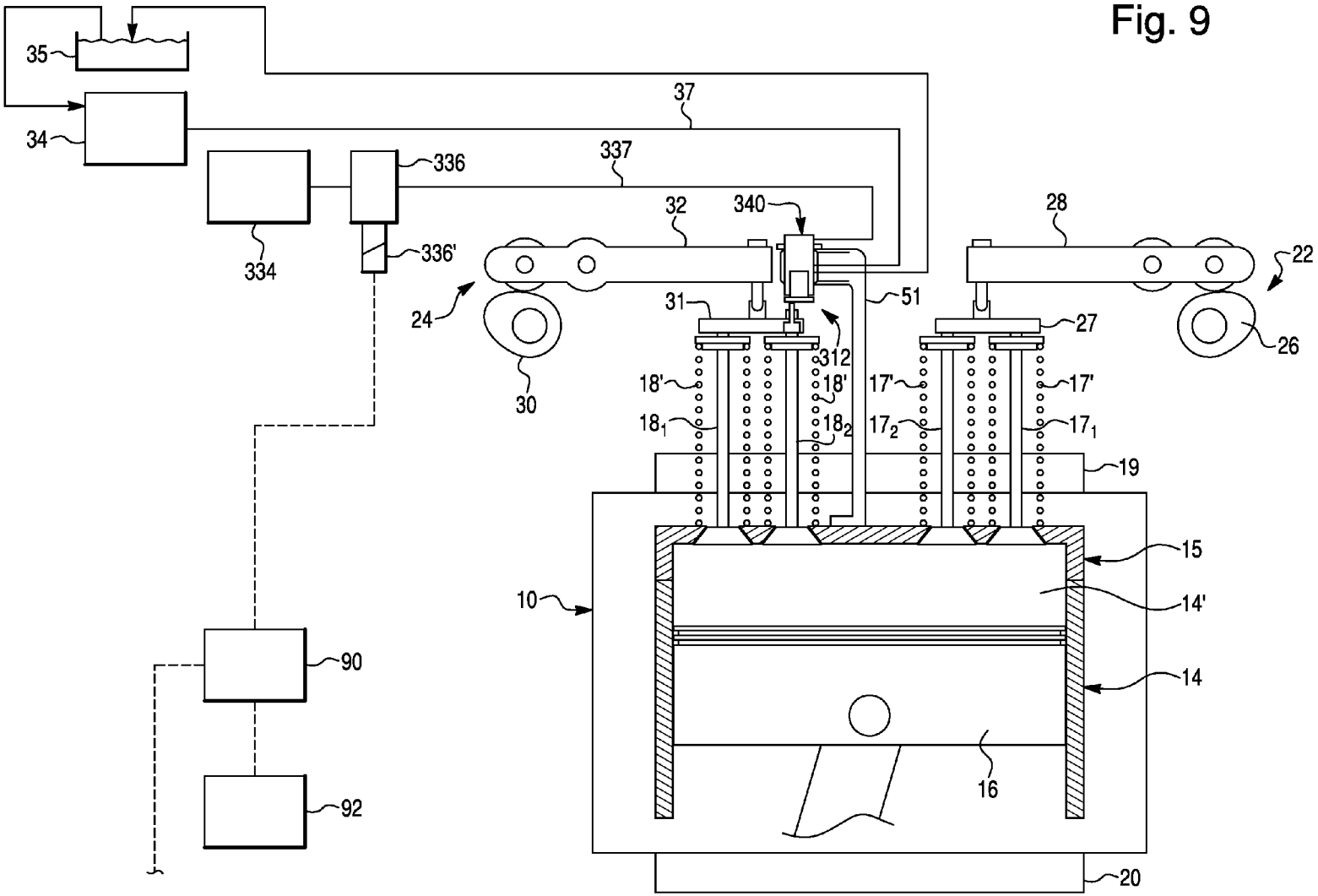
FIG. 9 is a schematic view of the internal combustion engine including a compression-release brake system according to a fourth exemplary embodiment of the present invention.
Figure 10:
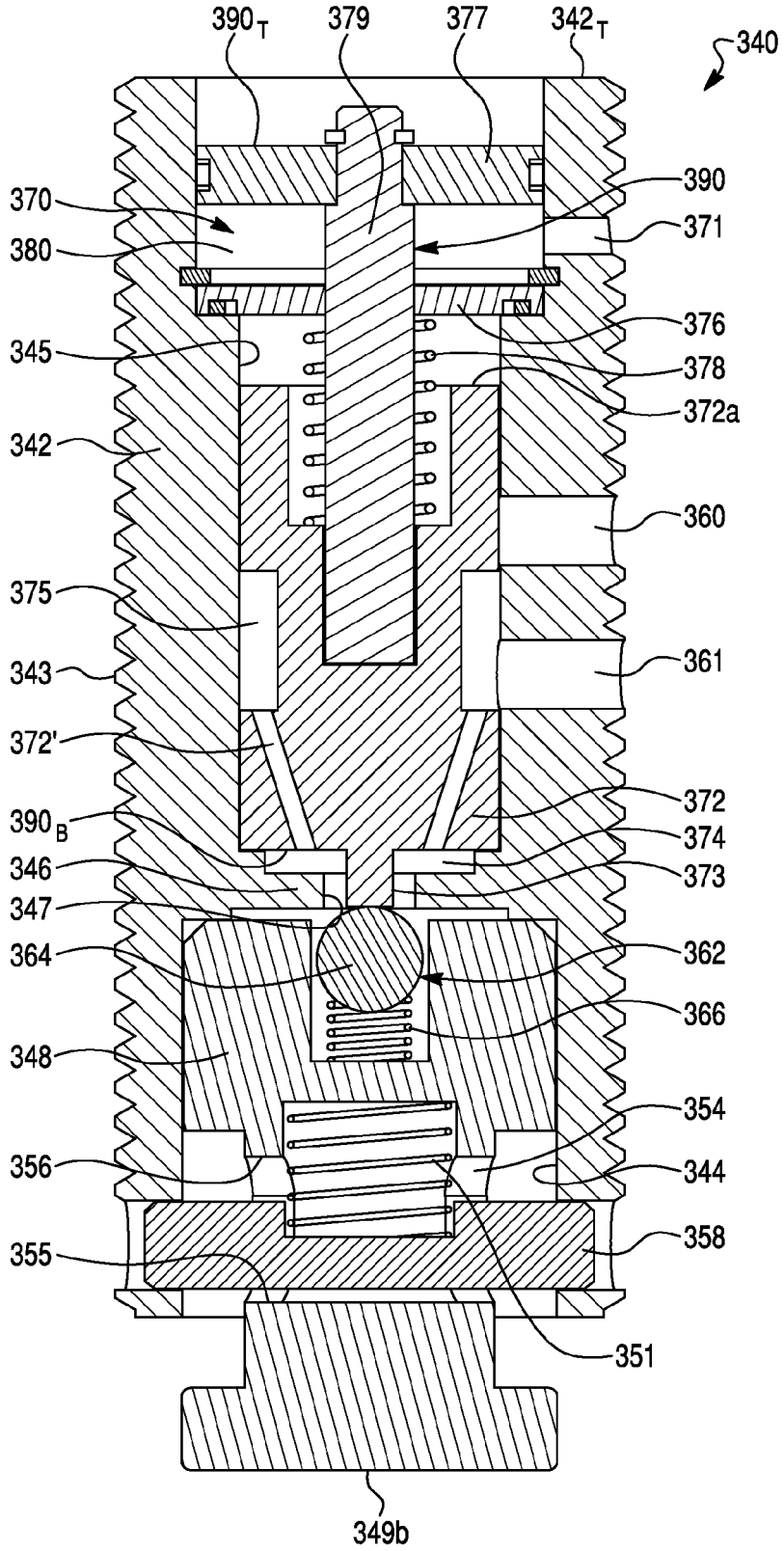
FIG. 10 is a sectional view of a pneumatically actuated compression brake control module of the compression-release brake system according to the fourth exemplary embodiment of the present invention in a depressurized condition.

FIGS. 9 and 10 illustrate a fourth exemplary embodiment of a compression-release brake system, generally depicted by the reference character 312, provided for an internal combustion (IC) engine 10. Components, which are unchanged from the first exemplary embodiment of the present invention, are labeled with the same reference characters. Components, which function in the same way as in the first exemplary embodiment of the present invention depicted in FIGS. 1-4 are designated by the same reference numerals to some of which 300 has been added, sometimes without being described in detail since similarities between the corresponding parts in the two embodiments will be readily perceived by the reader.

The main difference of the compression-release brake system 312 of FIGS. 9 and 10 with respect to the compression-release brake system 12 of FIGS. 1-4 is that a compression brake control module 340 of the compression-release brake system 312 according to the fourth exemplary embodiment of the present invention is pneumatically actuated. Moreover, as illustrated in FIG. 9, the compression-release brake system 312 with the pneumatically actuated compression brake control module 340 further includes a source 334 of a compressed air so as to provide the compressed air from the source 334 to the CBCM 340 through a compressed air passageway 337.

More specifically, as illustrated in details in FIG. 10, the CBCM 340 comprises a hollow casing in the form of a cylindrical single-piece body 342 defining a cylindrical piston cavity 344 and a cylindrical actuator cavity 345 separated by a inner (or separation) wall 346 and being in fluidly communication with each other through a connecting passage 347 in the inner wall 346. As further illustrated in FIG. 10, a cylindrical outer peripheral surface 343 of the casing 42 is at least partially threaded so as to be threadedly received in an internally threaded bore of a support member 51 fixed to a cylinder head 15 (or the cylinder block 14) of the I.C. engine 10 (as shown in FIG. 9). The CBCM 340 further comprises a slave piston 348 slidingly mounted within the casing 342 for reciprocating within the piston cavity 344 between an extended (outermost) position and a collapsed (innermost) position so that the casing 342 and the slave piston 348 define a variable volume hydraulic slave piston chamber 350 within an innermost portion of the cylindrical piston cavity 344 between an inner end face 349*a* of the piston 348 and the inner wall 346 of the casing 342. An outer end face 349*b* of the slave piston 348 is provided to engage the brake exhaust valve $\mathbf{18}_2$ in the extended position thereof through an exhaust valve pin 25 reciprocatingly mounted to the exhaust valve bridge 31. In other words, the exhaust valve pin 25 is reciprocatingly movable relative to the exhaust valve bridge 31 so as to make the brake exhaust valve $\mathbf{18}_2$ movable relative to the exhaust valve $\mathbf{18}_1$ and the exhaust valve bridge 31.

The slave piston 348 can reciprocate within the piston cavity 344 between two mechanical slave piston stops defining the extended position and the collapsed position. Preferably, the slave piston 348 is formed with an opening 354 having outer and inner stop surfaces 355 and 356, respectively, while the casing 342 is provided with a slave piston stop member 358 extending across the piston cavity 344 through the opening 354 between the outer and inner stop surfaces 355 and 356 thereof and to mechanically limit of inward and outward movements of the slave piston 348. As illustrated in FIG. 10, the distance between the outer and inner stop surfaces 355 and 356 is substantially larger than the height of the slave piston stop member 358 so as to allow the slave piston 348 to reciprocate within the piston cavity 344 between the outer and inner stop surfaces 355 and 356 of the opening 354. In other words, the slave piston 348 can extend outwardly from the piston cavity 344 until the inner stop surface 356 contacts the stop member 358, which is defined as the extended position thereof. Similarly, the slave piston 348 can retract inwardly into the piston cavity 344 until the outer stop surface 355 contacts the stop member 358, which is defined as the collapsed position of the slave piston 348. Thus, the stop member 358 functions as a stroke limiting member.

The pneumatically actuated CBCM 340 further comprises a supply (or inlet) conduit (port) 360 and a dumping conduit (port) 361 formed within the body 342 of the casing so as to provide the pressurized hydraulic fluid from a source 34 of a pressurized hydraulic fluid to the hydraulic slave piston chamber 350 through the connecting passage 347 to extend the slave piston 348 to the extended position thereof when there is a gap $\delta_A$ between the slave piston 348 and the exhaust valve pin 25 of the brake exhaust valve $\mathbf{18}_2$. Preferably, an engine lubricating oil is used as the working hydraulic fluid stored in a hydraulic fluid sump 35. It will be appreciated that any other appropriate source of the pressurized hydraulic fluid and any other appropriate type of fluid will be within the scope of the present invention. Thus, the pneumatically actuated CBCM 340 of the compression-release brake system 312 holds the brake exhaust valve $\mathbf{18}_2$ off the exhaust valve seat at a predetermined setting for the compression brake actuation mode of the I.C. engine 10.

The pneumatically actuated CBCM 340 further includes a pneumatic compression brake actuator 370 located within the actuator cavity 345 of the casing 342 and provided to selectively engage a ball member 364 of a check valve 362 when deactivated so as to unlock the hydraulic slave piston chamber 350 and fluidly connect the slave piston chamber 350 to the source 34 of the pressurized hydraulic fluid, and to disengage from the ball member 364 of the check valve 362 when activated so as to lock the slave piston chamber 350 and fluidly disconnect the slave piston chamber 350 from the source 34 of the pressurized hydraulic fluid. Moreover, as illustrated in FIG. 9, the compression-release brake system 312 with the pneumatically actuated compression brake control module 340 further includes a source 334 of a compressed air so as to provide the compressed air from the source 334 to the pneumatic actuator 370 of the CBCM 340 through the compressed air passageway 337, and an external compression brake control valve 336 provided to selectively fluidly connect the source 334 of the compressed air to the pneumatically actuated CBCM 340 through the passageway 337. In other words, the compression brake control valve 336 is provided to selectively supply the compressed air from the source 334 to the pneumatically actuated CBCM 340 so as to switch the CBCM 340 between an activated condition when the compressed air is supplied to the CBCM 340 and a deactivated (depressurized) condition when the compressed air is not supplied to the CBCM 340. Preferably, the compression brake control valve 336 is an external solenoid valve activated by an electromagnet (solenoid) 336' supplying the compressed air to the CBCM 340 during the compression brake actuation mode. To deactivate the compression-release brake system 312, the pressurized air is evacuated from the CBCM 340. In the pneumatic system, the supply engine oil is continuously connected to the inlet port 360 of the CBCM 340. The external three-way hydraulic solenoid valve is not required for the pneumatically actuated system.

The CBCM actuator 370 includes a spool valve 372 slidingly mounted within the casing 342 for reciprocating within the actuator cavity 345 between an extended position and a retracted position. The spool valve 372 is provided with a conduit 372' fluidly connecting an annular groove 375 of the spool valve 372 with the connecting passage 347 in the inner wall 346. An outer end face 372*a* of the spool valve 372 is provided to engage an end cap (or stop member) 376 in the retracted position thereof. As illustrated in FIG. 10, the end cap 376 is axially non-movably secured to the casing 342 so as to be axially inwardly spaced from a top end $\mathbf{342}_T$ of the casing 342. The pneumatic compression brake actuator 370 also includes a compression spring 378 acting between the spool valve 372 and the end cap 376 to bias the spool valve 372 toward the extended position thereof. The spool valve 372 is adapted to reciprocate between the inner wall 346 of the casing 342 and the end cap 376. As illustrated in FIG. 10, the spool valve 372 is formed integrally with a protrusion 373 extending into the connecting passage 347 in the inner wall 346 toward the valve member 364 of the check valve 362.

The pneumatic compression brake actuator 370 further includes an actuator piston 377 slidingly mounted within the casing 342 for reciprocating within the actuator cavity 345 between an extended position and a retracted position so as to form a pneumatic actuator chamber 380 between the end cap 376 and the actuator piston 377. The actuator piston 377 sealingly engages an inner wall of the actuator cavity 345. The pneumatically actuated CBCM 340 further comprises an air inlet port 371 formed within the body 342 so as to provide the compressed air from the source 334 to the pneumatic actuator chamber 380 through the compressed air passageway 337 to extend the actuator piston 377 to the extended position thereof. The top face of the actuator piston 377 is subject to atmospheric pressure. The actuator piston 377 is non-movably (i.e., integrally) connected to the spool valve 372 through a connecting shaft 379 so as to form an actuator element 390 of the pneumatic compression brake actuator 370 (shown in FIG. 10). The connecting shaft 379 slidingly extends through the end cap 376 so that the spool valve 372 and the actuator piston 377 are located on opposite sides of the end cap 376. In other words, the reciprocating actuator element 390 is slidingly mounted within the casing 342 for reciprocating within the actuator cavity 345 between an extended position (solely by the biasing force of the compression spring 378) and a retracted position (by pneumatic pressure the compressed air moving the actuator piston 377 outwardly from the casing 342) so that the casing 342 and the actuator element 390 define a variable volume actuator chamber 374 within an innermost portion of the cylindrical actuator cavity 345 between an inner end (or bottom) face $\mathbf{390}_B$ of the actuator element 390 (defined by an inner end face of the spool valve 372) and the inner wall 346 of the casing 342. The actuator element 390 is subject to atmospheric pressure so that an outer end (or top) face $\mathbf{390}_T$ of the actuator element 390 (defined by an outer end face of the actuator piston 377) is exposed to atmospheric pressure.

The operation of the compression-release brake system 312 is described in detail below.

Compressed air is supplied to the air inlet port 371 forcing the actuator piston 377 to stroke up until the outer end face 372*b* of the spool valve 372 contacts the stop member 376. The spool valve movement opens the engines oil supply port 360 and closes the oil dumping port 361. In addition, the upward spool movement allows the ball check valve 364 to close, thereby sealing the slave piston chamber 350. The oil supply pressure flows through the ball check valve 362 and into the slave piston chamber 350. The force on the slave piston 348 from the oil pressure supply moves the slave piston 348 down until the slave piston 348 contacts the slave piston stop 358 when the exhaust valve 18 is off the valve seat during the normal exhaust valve lift. The spring loaded check ball 364 locks the oil above the slave piston 348, preventing the slave piston 348 from returning. The slave piston 348 is now locked in place by the trapped oil in the slave piston chamber 350, which prevents the exhaust valve 18 from returning to the valve seat. The location of the slave piston stop 358 determines the amount of distance that the exhaust valve 18 is held off the valve seat during the engine braking mode.

When the engine braking mode is deactivated, the compressed air is released from the pneumatic actuator chamber 380, allowing the spool valve 372 (or the actuator element 390) to be forced downward (or inwardly) solely by the biasing force of the compression spring 378 and open the check valve 362. This allows the slave piston 348 to move upward by a compression spring 351 until the outer stop surface 355 of the slave piston 348 contacts the slave piston stop 358. In other words, the compression spring 351 biases the slave piston 348 toward the collapsed position thereof. The movement of the spool valve 372 (or the actuator element 390) closes the supply oil port 360, opens the dumping port 361 and forces the ball check 364 off its seat, thereby releasing the oil from the slave piston chamber 350. The released oil flows out the slave piston chamber 350 and through the connecting passage 347 and the dumping port 361 back to the oil sump 35. The slave piston 348 is forced back to the seated position in the housing 342 by the exhaust valve spring 18' and the compression spring 351. The exhaust valve 18 returns to the valve seat to allow for normal engine valve operation.

Figure 11:
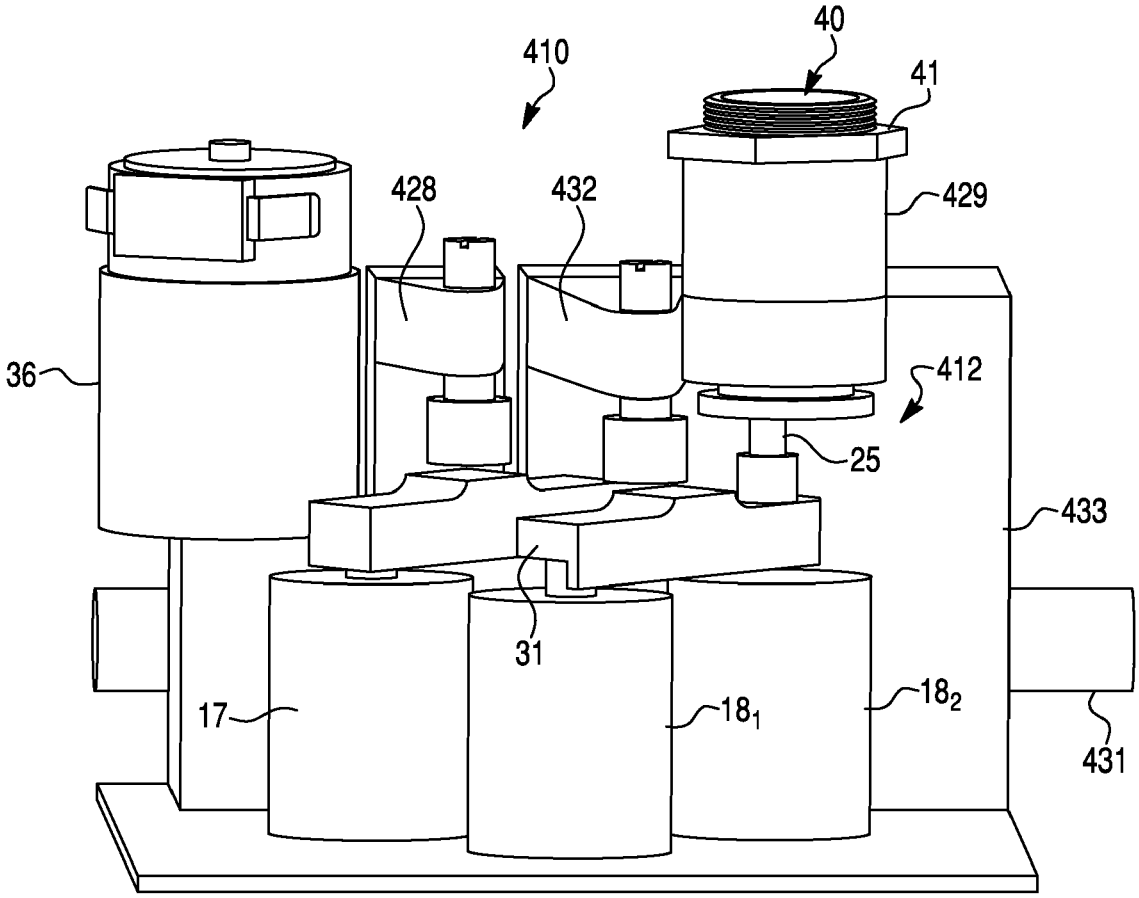
FIG. 11 is a prospective view of a compression-release brake system according to a fifth exemplary embodiment of the present invention.
Figure 12:
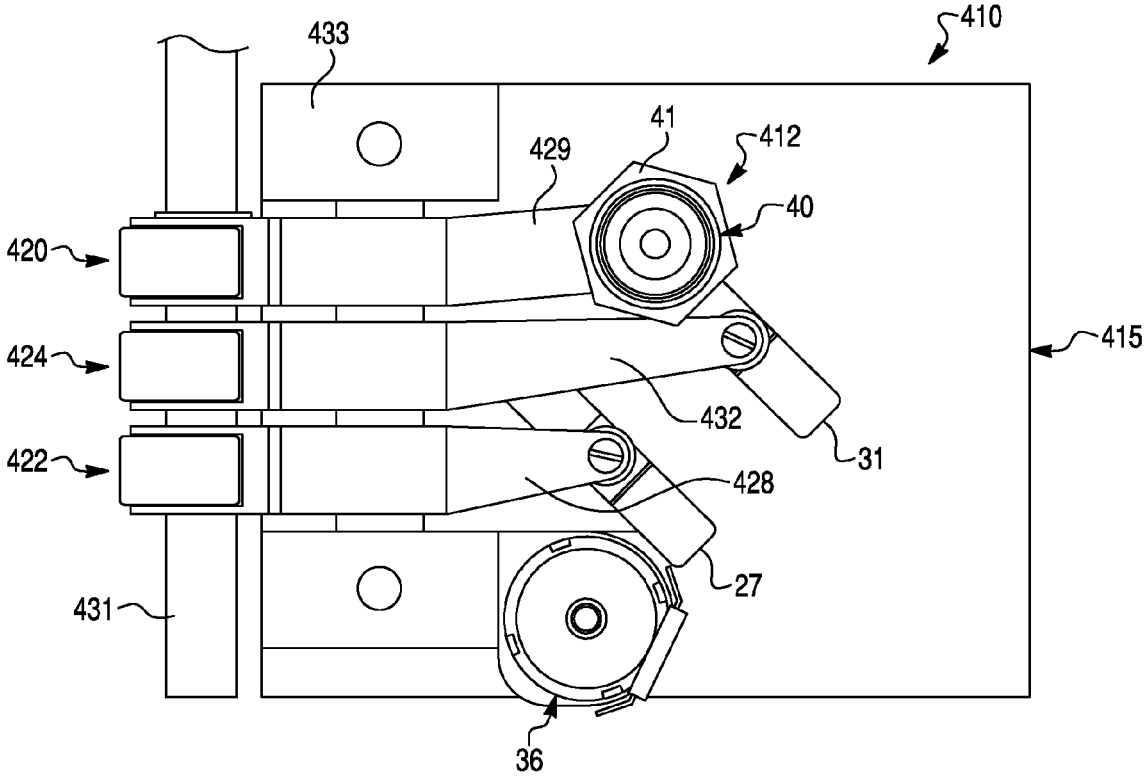
FIG. 12 is a top view of the compression-release brake system according to the fifth exemplary embodiment of the present invention.
Figure 13:
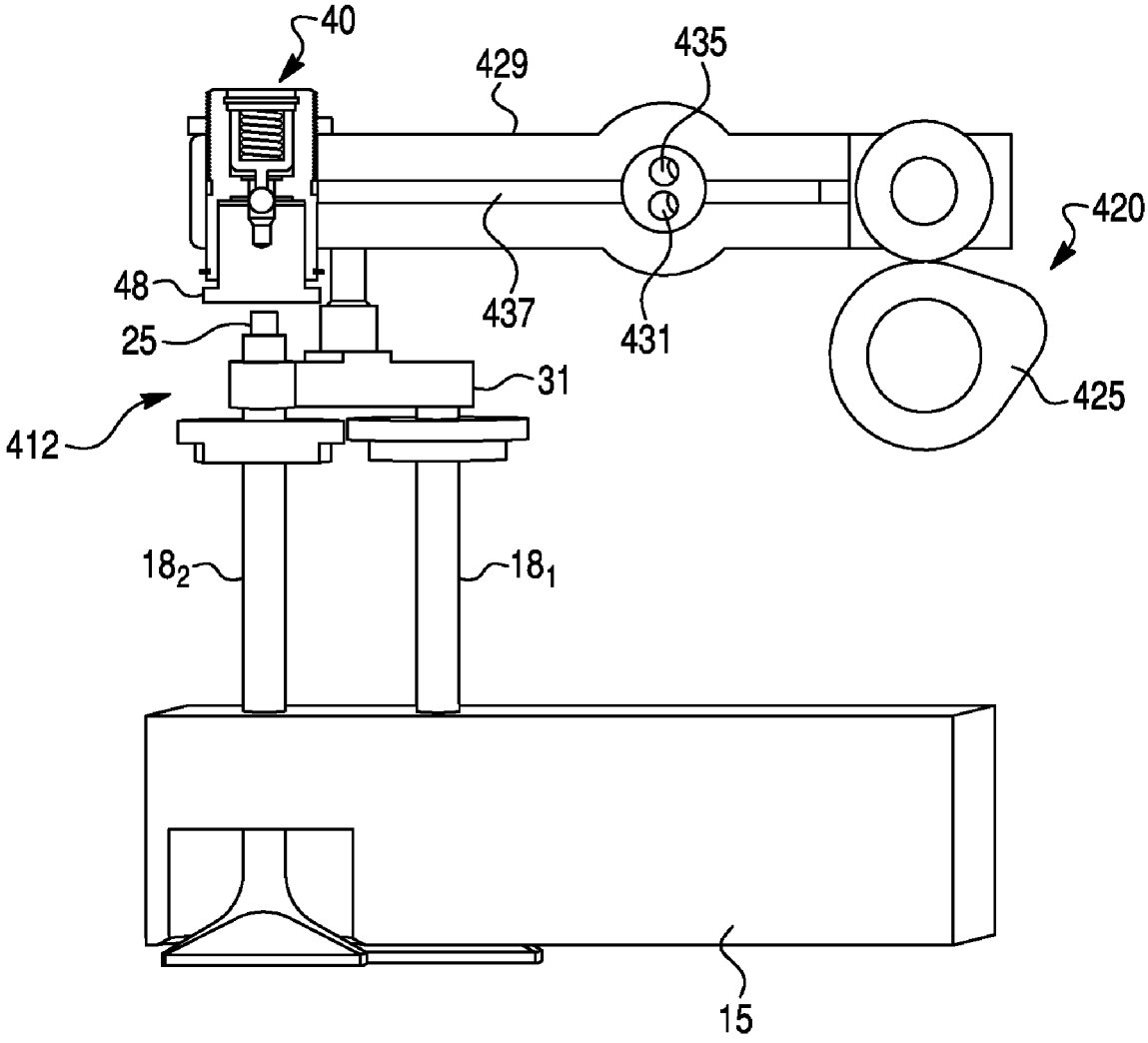
FIG. 13 is a partial sectional view of the compression-release brake system according to a fifth exemplary embodiment of the present invention including the hydraulically actuated compression brake control module.

FIGS. 11-13 illustrate a fifth exemplary embodiment of a compression-release brake system (or dedicated cam engine brake system), generally depicted by the reference character 412, provided for an internal combustion (IC) engine 410. Components, which are unchanged from the first exemplary embodiment of the present invention, are labeled with the same reference characters. Components, which function in the same way as in the first exemplary embodiment of the present invention depicted in FIGS. 1-4 are designated by the same reference numerals to some of which 400 has been added, sometimes without being described in detail since similarities between the corresponding parts in the two embodiments will be readily perceived by the reader.

The compression-release brake system 412 according to the fifth exemplary embodiment of the present invention includes a dedicated brake rocker assembly 420 added to each engine cylinder in addition to conventional intake and exhaust rocker assemblies 422 and 424, respectively. The dedicated brake rocker assembly 420 comprises a dedicated compression-release cam member 425 (shown in FIG. 13) added to each engine cylinder in addition to conventional intake and exhaust cam members. Correspondingly, the dedicated brake rocker assembly 420 also includes a dedicated brake rocker arm 429 in addition to conventional intake and exhaust rocker arms 428 and 432, respectively. Preferably, the IC engine 410 is a four-stroke diesel engine. The dedicated compression-release brake system 412 employs a self-contained compression brake control module (CBCM) to remove valve lash from a brake valve train to activate the engine brake to open a single exhaust valve or both exhaust valves at a fast rate of rise with the maximum allowable lift near TDC compression stroke. This will obtain a high peak cylinder pressure and quick cylinder blow-down during the beginning of the expansion stroke and a high degree of engine brake retarding power from a diesel engine 410.

The self-contained compression brake control module (CBCM) according to the fifth exemplary embodiment of the present invention may be a hydraulically actuated CBCM 40 of FIGS. 3 and 4 according to the first exemplary embodiment of the present invention (as illustrated in FIGS. 11-13), an electrically actuated CBCM 140 of FIGS. 6 and 7 according to the third exemplary embodiment of the present invention, or a pneumatically actuated CBCM 340 of FIG. 10 according to the fourth exemplary embodiment of the present invention. As illustrated in FIGS. 11-13, the CBCM 40 is mounted to one end of the brake rocker arm 429 so that the CBCM 40 is disposed adjacent to the inner exhaust valve $\mathbf{18}_2$ for operatively coupling the dedicated brake rocker assembly 420 with the inner exhaust valve $\mathbf{18}_2$. However, it will be appreciated that the CBCM 40 is effective when placed at any position in the exhaust valve train. A fluid channel (oil conduit) 437 is provided within the brake rocker arm 429 in order to provide a fluid communication between the CBCM 40 and the source 34 of the pressurized hydraulic fluid.

To activate the compression-release brake system 412, engine oil supply is provided through a rocker pedestal 433 to the engine brake solenoid valve 36. When engine braking is activated, the solenoid valve 36 allows the pressurized oil flow through an exit passageway in the rocker pedestal 433 through dedicated brake oil drilling 435 in the rocker shaft 431 and then into the oil conduit 437 formed in the brake rocker arm 429 and finally into the CBCM 40 over the brake exhaust valve $\mathbf{18}_2$, as shown in FIG. 13. The pressure and flow of the hydraulic fluid into the CBCM 40 forces the slave piston 48 down to remove all the lash in the brake rocker assembly 420 and locks the fluid in the slave piston chamber 50 to activate brake valve motion. To turn the engine brake off, supply voltage is turned off venting the supply pressure oil and allowing the actuator piston spring 78 to move the actuator piston 72 down which pushes the check ball 64 off its seat. This allows oil from the slave piston chamber 50 to flow back to the oil sump 35 through the brake rocker arm 429, the rocker shaft 431 and a dump port of the engine brake solenoid valve 36. The slave piston 48 of the CBCM 40 will be forced up in its bore by the exhaust valve upward stroke. Moreover, the inner exhaust valve $\mathbf{18}_2$ is preferred to reduce dedicated cam loading. If either of the exhaust valves 18 were opened or the outer exhaust valve $\mathbf{18}_1$ was opened the cam and valve train loading would be greater. Higher valve train loading results in engine durability concerns.

The operation of the compression-release brake system 412 is described in detail below.

With the dedicated cam engine brake system 412, the brake camshaft member 425 is added to each cylinder to provide the lift profile to open the compression release brake exhaust valve $\mathbf{18}_2$. The difference between the constant lift weeper brake system and the dedicated cam engine brake system is the dedicated cam engine brake system has a variable exhaust valve lift profile that doesn't release any compressed air during the compression stroke until near TDC compression stroke. The weeper brake system, since the exhaust valve is continuously open during the compression stroke, allows cylinder compressed air to escape through the slightly opened valve opening. Because the dedicated cam engine brake system doesn't bleed any cylinder air mass until near TDC compression, more work is done on the air with the dedicated cam engine brake system during compression.

At the start of the expansion stroke, the weeper lift is small compared to the dedicated cam brake lift, so the cylinder blow-down during the expansion stroke for the dedicated cam brake system is greater. The net result is that less work is obtained during the weeper stroke than the dedicated cam compression stroke and therefore the dedicated cam retarding power is much larger. The oil supply to the dedicated cam brake system can be routed from the engine oil pump 34 to the rocker pedestal 433 to the exterior engine brake solenoid valve 36 installed in the rocker pedestal 433. Down-stream of the solenoid valve 36 the engine brake supply oil can be routed through the brake drilling 435 in the rocker shaft 431 to the brake rocker arm 429 to supply the oil inlet port of the CBCM 40. The CBCM 40 can be arranged in the brake rocker arm 429 located over the inner exhaust valve (or brake exhaust valve) $\mathbf{18}_2$. The exhaust valve bridge 31 that bridges the two exhaust valves 18 shown in FIGS. 11-13, incorporates an exhaust valve pin 25 that allows the slave piston 48 to press against the brake exhaust valve $\mathbf{18}_2$ to open the brake exhaust valve $\mathbf{18}_2$ (one of the two exhaust valves 18).

When the engine brake solenoid valve 36 is activated, the pressurized oil flows into the CBCM 40 and the slave piston 48 extends to the stop. The ball check valve 62 is allowed to check the oil in the slave piston chamber 50 to lock the extended slave piston 48 in the extended position. The extended slave piston 48 removes all or nearly all of the valve train lash to activate the dedicated brake cam 425. The dedicated cam 425 forces the extended slave piston 48 to contact the exhaust valve bridge pin 25 near TDC compression. It then continues to open the brake exhaust valve $\mathbf{18}_2$ at a fast rate of rise to maximum brake lift near TDC compression and to close the brake exhaust valve $\mathbf{18}_2$ soon after TDC compression during the beginning of the expansion stroke. The profile of the engine brake dedicated cam member 425 is designed to optimize engine brake retarding performance and to meet EOEM valve train and other engine design specifications.

Therefore, the present invention provides a novel compression-release brake system for an internal combustion including a self-contained compression brake control module in the form of a hydraulically expandable linkage that is integrated into the valve train of the I.C. engine. The present invention provides the following design advantages over the prior art:

Small Compact Design—Fits under valve cover without major modification of existing fuel injection or valve train components and minimum increased valve cover height;

Individual Cylinder Application—Unique design provides design flexibility to install the CBCM on engines configurations with a single valve cover per cylinder;

Minimum Fluid Compliance—A check valve locking pressurized hydraulic fluid in a slave piston chamber provides a design using a minimum fluid volume thereby reducing the compliance of the trapped hydraulic fluid yielding a stiffer system to maintain a fairly constant exhaust valve(s) lift at higher engine loading in the engine braking mode;

Universal Design—Can accommodate most engine configuration with the same CBCM integrated hardware design with the exception of mounting the CBCM to the rocker arm overhead or cylinder head.

Lower Engineering Cost—Because of universal CBCM design, different engine applications can be accomplished with much lower engineering design, prototype fabrication and validation testing;

Reduced Development Time—New engine applications will not require designing complete engine brake hardware but only require adapting to specific mounting locations on the engine cylinder head and/or valve train;

Reduced Component Cost—Standardization of the universal design CBCM components increases volume of similar parts, thus enabling lower manufacturing and purchasing costs;

Hydraulic CBCM—The slave piston has a seal which eliminates piston to bore leakage and holds the slave piston in the upper or off position when the CBCM is off; and Component Flexibility—The engine manufacturer or the engine brake manufacturer can supply brackets to mount the CBCM to the engine overhead. This allows for the engine manufacture to choose the low cost option. Other components besides the CBCM have the same option.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A compression-release brake system for operating at least one exhaust valve of an internal combustion engine during a compression-release engine braking operation, said system comprising:

an exhaust rocker assembly for operating said at least one exhaust valve, said exhaust rocker assembly including an exhaust rocker arm driven by an exhaust cam member;

a self-contained compression brake control module operatively coupled to said at least one exhaust valve for controlling a lift and a phase angle of said at least one exhaust valve; and a source of a pressurized hydraulic fluid in fluid communication with said compression brake control module;

said compression brake control module provided to maintain said at least one exhaust valve open during a compression stroke of the engine when said engine performs the compression-release engine braking operation;

said compression brake control module including:

a casing including a single-piece body defining a piston cavity and an actuator cavity separated by a separation wall and being in fluid communication with each other through a connecting passage in said separation wall;

a slave piston slidingly mounted within said piston cavity for reciprocating within said piston cavity between an extended position and a collapsed position, said slave piston being provided to engage said at least one exhaust valve in said extended position thereof;

said casing and said slave piston defining a variable volume hydraulic slave piston chamber within said piston cavity between said separation wall and said slave piston;

a supply conduit formed within said body of said casing so as to provide the pressurized hydraulic fluid from said source of pressurized hydraulic fluid to said hydraulic slave piston chamber to extend said slave piston to said extended position thereof when there is a gap between said slave piston and said at least one exhaust valve;

a check valve provided between said supply conduit and said hydraulic slave piston chamber to hydraulically lock said hydraulic slave piston chamber by closing said connecting passage in said separation wall when a pressure of the hydraulic fluid within said hydraulic slave piston chamber exceeds the pressure of the hydraulic fluid from said source; and a compression brake actuator disposed in said actuator cavity;

said compression brake actuator including an actuator element slidingly mounted within said actuator cavity for reciprocating between an extended position when deactivated and a retracted position when activated, and a compression spring biasing said actuator element toward said extended position thereof;

said actuator element selectively engaging and opening said check valve when deactivated solely by the biasing force of said compression spring so as to unlock said hydraulic slave piston chamber and fluidly connect said hydraulic slave piston chamber to said source of pressurized hydraulic fluid, and disengaging from said check valve when activated so as to lock said hydraulic slave piston chamber and fluidly disconnect said hydraulic slave piston chamber from said source of pressurized hydraulic fluid, said actuator element being exposed to atmospheric pressure.

2. The compression-release brake system as defined in claim 1, wherein said actuator element has a bottom face exposed to said hydraulic fluid and a top face exposed to the atmospheric pressure.

3. The compression-release brake system as defined in claim 2, wherein said compression brake control module is spaced from said exhaust rocker assembly so that said exhaust rocker assembly is movable relative to said compression brake control module; and wherein said single-piece body of said compression brake control module is non-movably fixed to one of a cylinder head and a cylinder block of said engine.

4. The compression-release brake system as defined in claim 3, wherein said single-piece body of said compression brake control module has a cylindrical outer peripheral surface, which is at least partially threaded so as to be threadedly mounted to said engine.

5. The compression-release brake system as defined in claim 3, wherein said actuator cavity of said single-piece body of said compression brake control module is closed with an end cap provided with a vent port.

6. The compression-release brake system as defined in claim 5, wherein said actuator element has a bottom face exposed to said hydraulic fluid and a top face exposed to the atmospheric pressure.

7. The compression-release brake system as defined in claim 6, wherein said actuator element defines a variable volume actuator chamber within an innermost portion of said actuator cavity between said bottom face thereof and said separation wall of said casing and a vent chamber within an innermost portion of said actuator cavity between said top face of said actuator element and said end cap; said compression spring is disposed in said vent chamber.

8. The compression-release brake system as defined in claim 7, further comprising a compression brake control valve provided outside said compression brake control module to selectively supply the pressurized hydraulic fluid from said source to said compression brake control module so as to switch said compression brake control module between a pressurized condition when the pressurized hydraulic fluid is supplied to said compression brake control module and a depressurized condition when the pressurized hydraulic fluid is not supplied to said compression brake control module.

9. The compression-release brake system as defined in claim 8, wherein said compression brake control valve is an external three-way solenoid valve activated by a solenoid.

10. The compression-release brake system as defined in claim 9, further including an electronic controller operatively connected to said compression brake control valve for selectively opening thereof depending on operating parameters of the engine.

11. The compression-release brake system as defined in claim 10, further including a plurality of sensors representing operating parameters of the engine, said sensors operatively connected to said electronic controller.

12. The compression-release brake system as defined in claim 8, wherein said compression brake actuator is activated when said compression brake control valve is open to supply the pressurized hydraulic fluid from said source to said compression brake control module and said compression brake control module is in said pressurized condition so that the pressurized hydraulic fluid moves said actuator element to said extended position.

13. The compression-release brake system as defined in claim 12, wherein said compression brake actuator is deactivated when said compression brake control valve is closed to prevent supply of the pressurized hydraulic fluid from said source to said compression brake control module and said compression brake control module is in said depressurized condition so that said actuator element moves to said collapsed position solely by the biasing force of said compression spring.

14. The compression-release brake system as defined in claim 7, wherein said compression brake actuator comprises a solenoid including a solenoid coil fixed to an inner peripheral surface of said actuator cavity of said casing and said actuator element in the form of an armature slidingly mounted within said solenoid coil for reciprocating therewithin between said extended position and said retracted position so that said casing and said armature define a variable volume actuator chamber within an innermost portion of said cylindrical actuator cavity between said bottom face of said armature and said separation wall of said casing and a vent chamber within an innermost portion of said actuator cavity between said top face of said armature and said end cap; said compression spring is disposed in said vent chamber.

15. The compression-release brake system as defined in claim 14, wherein said armature is provided with a fluid conduit therethrough fluidly connecting said actuator chamber with said vent chamber.

16. The compression-release brake system as defined in claim 14, further including an electronic controller operatively connected to said solenoid for selectively operating said compression brake actuator depending on operating parameters of the engine.

17. The compression-release brake system as defined in claim 16, further comprising a compression brake control valve provided outside said compression brake control module to selectively supply the pressurized hydraulic fluid from said source to said compression brake control module so as to switch said compression brake control module between a pressurized condition when the pressurized hydraulic fluid is supplied to said compression brake control module and a depressurized condition when the pressurized hydraulic fluid is not supplied to said compression brake control module.

18. The compression-release brake system as defined in claim 17, wherein said compression brake control valve is an external three-way solenoid valve activated by a solenoid.

19. The compression-release brake system as defined in claim 18, wherein said electronic controller is operatively connected to said compression brake control valve for selectively opening thereof depending on operating parameters of the engine.

20. The compression-release brake system as defined in claim 1, wherein said casing includes a slave piston stop member and said slave piston comprises axially opposite outer and inner stop surfaces so that in said extended position of said slave piston said inner stop surface of said slave piston contacts said slave piston stop member and in said collapsed position of said slave piston said outer stop surface of said slave piston contacts said slave piston stop member.

21. The compression-release brake system as defined in claim 20, wherein said slave piston is formed with an annular piston groove having said axially opposite outer and inner stop surfaces, and wherein said slave piston stop member in the form of a snap ring, which is seated in a complementary groove formed in a lower interior portion of said casing so as to extend into said piston groove between said outer and inner stop surfaces thereof so as to mechanically limit of inward and outward movements of said slave piston.

22. The compression-release brake system as defined in claim 1, wherein said slave piston is provided with an elastomeric seal to eliminate piston to bore leakage in said extended position of said slave piston.

23. The compression-release brake system as defined in claim 3, wherein said actuator cavity of said single-piece body of said compression brake control module is closed with an end cap axially non-movably secured to said casing so as to be axially inwardly spaced from a top end thereof;

wherein actuator element includes a spool valve and an actuator piston integrally connected by a connecting shaft so as to form said actuator element, said connecting shaft slidingly extending through said end cap so that said spool valve and said actuator piston are located on opposite sides of said end cap;

wherein said casing and said actuator element define a variable volume actuator chamber within an innermost portion of said cylindrical actuator cavity between a bottom face of said actuator element defined by an inner end face of said spool valve and said separation wall of said casing; and wherein a top face of said actuator element defined by an outer end face of said actuator piston is exposed to atmospheric pressure.

24. The compression-release brake system as defined in claim 23, wherein said compression brake actuator further includes a pneumatic actuator chamber formed between said end cap and said actuator piston.

25. The compression-release brake system as defined in claim 24, further comprising a source of compressed air in fluid communication with said compression brake control module and an air inlet port formed within said body so as to provide the compressed air from said source of compressed air to said pneumatic actuator chamber.

26. The compression-release brake system as defined in claim 23, wherein said compression brake actuator further includes a compression spring acting between said spool valve and said end cap to bias said actuator element toward said extended position thereof.

27. The compression-release brake system as defined in claim 23, wherein said casing includes a slave piston stop member and said slave piston comprises axially opposite outer and inner stop surfaces so that in said extended position of said slave piston said inner stop surface of said slave piston contacts said slave piston stop member and in said collapsed position of said slave piston said outer stop surface of said slave piston contacts said slave piston stop member.

28. The compression-release brake system as defined in claim 27, further comprising a compression spring biasing said slave piston toward said collapsed position thereof.

29. The compression-release brake system as defined in claim 2, further comprising a dedicated brake rocker assembly operating said at least one exhaust valve during the compression-release engine braking operation; said dedicated brake rocker assembly including a dedicated brake rocker arm driven by a dedicated compression-release cam member; wherein said single-piece body of said compression brake control module is mounted to one end of said dedicated brake rocker arm adjacent to said at least one exhaust valve for operatively coupling said dedicated brake rocker assembly with said at least one exhaust valve.

30. The compression-release brake system as defined in claim 29, wherein said dedicated brake rocker assembly further includes a fluid channel providing the pressurized hydraulic fluid from said source to said hydraulic slave piston chamber.

31. The compression-release brake system as defined in claim 29, wherein said compression brake actuator of said compression brake control module is one of a hydraulic actuator, an electric actuator and a pneumatic actuator.

32. The compression-release brake system as defined in claim 1, wherein said engine has an exhaust brake provided to generate an exhaust backpressure sufficient to cause said at least one exhaust valve to open near a bottom dead center of an intake stroke of the engine during the engine braking operation.

33. The compression-release brake system as defined in claim 32, wherein said exhaust brake includes a butterfly valve operated by an exhaust brake actuator.

34. The compression-release brake system as defined in claim 33, wherein said exhaust brake includes a variably restrictive turbocharger.

35. The compression-release brake system as defined in claim 32, further including an exhaust brake electronic controller operatively connected to said exhaust control valve for selectively opening thereof depending on operating demand of the engine and to said exhaust brake so as to adjust said exhaust brake during braking operation of said variable valve actuation system so that the exhaust pressure is sufficient to cause said at least one exhaust valve to open.

36. The compression-release brake system as defined in claim 32, wherein said exhaust brake generates the exhaust backpressure sufficient to cause said at least one exhaust valve to open prior to the bottom dead center of an intake stroke of the engine when said compression brake control module is in said pressurized condition during the engine braking operation.

* * * * *